US006422017B1

(12) United States Patent
Bassily

(10) Patent No.: US 6,422,017 B1
(45) Date of Patent: Jul. 23, 2002

(54) REHEAT REGENERATIVE RANKINE CYCLE

(76) Inventor: Ashraf Maurice Bassily, 1479 Hawthorn Ct., Ames, IA (US) 50010

( * ) Notice: Subject to any disclaimer, the term of this patent is extended or adjusted under 35 U.S.C. 154(b) by 0 days.

(21) Appl. No.: 09/146,511

(22) Filed: Sep. 3, 1998

(51) Int. Cl.[7] ..... F01K 7/34
(52) U.S. Cl. ..... 60/653; 60/679; 60/682
(58) Field of Search ..... 60/653, 679, 682

(56) References Cited

U.S. PATENT DOCUMENTS

| | | | | |
|---|---|---|---|---|
| 3,724,212 A | * | 4/1973 | Bell | 60/653 X |
| 4,274,259 A | * | 6/1981 | Silvestri, Jr. | 60/653 X |
| 4,352,270 A | * | 10/1982 | Silvestri, Jr. | 60/653 X |
| 4,873,827 A | * | 10/1989 | Hadano et al. | 60/679 X |
| 5,570,579 A | * | 11/1996 | Saujet et al. | 60/679 X |

* cited by examiner

*Primary Examiner*—Hoang Nguyen

(57) ABSTRACT

Reheat of reheat regenerative steam power cycle increases its efficiency by increasing the average temperature of heat reception. In spite of such an increase in efficiency, reheating increases the irreversibility of feed water heaters by using superheated steam of a greater temperature difference in the regenerative cycle. This invention introduces some modifications to the regular reheat regenerative steam power cycle that reduces the irreversibility of the regenerative process. The invention applies reversible reheating in addition to the regular reheating and uses smaller temperature differences across feed water heaters than the regular cycle. A comparison study between the regular reheat regenerative cycle and the invented cycle is done. The results indicate that a gain in efficiency of up to 2.5% is obtained when applying invented cycle at the same conditions of pressure, temperatures, number of reheating stages, and feed water heaters. In addition, the invented cycle has some practical advantages associated with up to 50% reduction in the mass flow rate that is regularly reheated for the same output power. Such advantages such as less pressure drop and heat transfer loss. Such advantages allow us to use a greater number of reheating stages of the invented cycle for the same pressure drop and heat transfer losses of the reheater pipes of the regular cycle. Another practical advantage of the invented cycle over the regular cycle is higher heat transfer coefficients for the heat exchangers of the feed water heaters because they are mainly operated in the two-phase region. Such practical advantage results in smaller sizes for the heat exchangers of the invented cycle compared with the ones for the regular cycle.

8 Claims, 20 Drawing Sheets

REHEAT REGENERATIVE RANKINE CYCLE

REFERENCES CITED

Bassily, A. M., 1999, "Improving the Efficiency and Availability Analysis of a Modified Reheat Regenerative Rankine Cycle" Proceedings of the Renewable and Advanced Energy Systems for the 21st Century, Lahaina, Maui, Ha. April 11–15.

Moran, M. J., and Shapiro, H. N., 1995, *Fundamentals of Engineering Thermodynamics*, John Wiley & Sons, Inc., New York, 3rd Edition, pp. 590–610.

TECHNICAL FIELD

The present invention relates to the field of power generation system of the continuous combustion type using steam as the working medium. The general objective of the invention is to provide a system of power generation, having higher efficiency than the current systems while maintaining low capital cost, leading to a total running cost that is lower than the total running cost of the existing systems.

BACKGROUND OF THE INVENTION

Increasing the efficiency of power generation can be done by increasing the average temperature of heat reception through regeneration or reheating. The main purpose of reheating is to ensure high efficiency of expansion through steam turbines. The average temperature of heat reception can be increased through raising the steam generator pressure ($P_x$). As $P_x$ increases, there will be need for more stages of reheating to ensure high efficiency of expansion in steam turbines. As the number of reheating stages grows, more steam will be extracted for regeneration at high superheat temperature that has high temperature difference of heat transfer. Such a high temperature difference of heat transfer increases the irreversibility of feed water heaters. There is no feasible method is known to reduce the irreversibility of feed water heaters in case of using superheated steam for feed heating. This invention introduces some modifications to the Rankine Reheat Regenerative cycles that reduce the regeneration irreversibility and increase the cycle efficiency.

BRIEF SUMMARY OF THE INVENTION

The invention is particularly advantageous for use in systems that use steam as a working medium; however, the invention is also advantageous for power systems that use any other fluids as working media. The invention can also be applied to the combined cycle power systems and Binary cycle power systems.

In general, it may be said that I attain the principal object of the invention, as well as the other objects thereof which will hereinafter appear, by further expanding the required amount of the working medium to be reheated just for the purpose of further expanding it in rotary turbines to produce power. The required amount of the working medium to heat the fluid entering each feed heater is extracted at almost the same pressure that corresponds to that heater. The remainder amount of that required for feed generation of the working medium after expansion if it is in a two-phase condition is allowed to enter a separator to convert the inlet two phase of the working medium to two outlets. The first outlet is dry gas and the second outlet is liquid. The dry gas will either be reheated to higher temperature just for the purpose of effective expansion in the following stage of expansion in a rotary turbine, or will be allowed to expand in the following stage of expansion without reheating. The liquid working medium out of the separator will mix with the outlet of that feed heater. If the remainder amount of that required for feed regeneration after expansion was in a gas phase condition, it is allowed to expand further in the same rotary turbine to the pressure that equal to the pressure of the next feed heater. By this process, I am enable to use working medium in a two-phase region to heat the feed heater at a pressure that is almost equal to the pressure of that heater, resulting:

First, a reduction in the feed water heater irreversibility since the temperature difference of heat transfer is minimum, resulting in a higher efficiency for the power system.

Second, a higher heat transfer coefficient since the heat transfer coefficient of the condensing two-phase working medium used to heat the working medium entering feed heater is up to 200 times that of a gas-phase working medium, resulting in a smaller and cheaper heat exchange units for feed generation.

Third, the amount of working medium that is expanded further for the purpose of power generation is reduced significantly. The results show that up to 50% reduction in the mass flow rate of the reheater pipes of the invented cycle over the regular current Rankine reheat regenerative cycle at the same conditions of temperatures, pressures, number of feed water heaters, and reheating stages. Such results lead to up to 75% reduction in the pressure drop of the reheater pipes and significant reductions in the heat transfer losses from such pipes (assuming the same pipe sizes and coefficients of friction), resulting in further improvement in thermal efficiency.

Therefore, implementing the invention is expected to reduce the capital cost of the equipment and the cost of energy to run it, resulting in a reduction of the total cost. The invention is applicable to many different arrangements of power systems and for the purpose of illustration I have shown in the accompanying drawing several schematic diagrams for carrying the invention into effect, together with the corresponding illustrations of the thermal characteristics of those cycles.

In the systems illustrated, the working medium is water in the liquid phase, steam in the gas phase. Any kind of fuel can be applied to those systems such as fossil fuel (oil, natural gas, coal), nuclear fuel. For convenience, I will refer, but without limitation to the working fluid as water in a liquid form and steam in a gas form. It is understood that other media having equivalent functions may be employed instead.

DETAILED DESCRIPTION

Figure 1A:
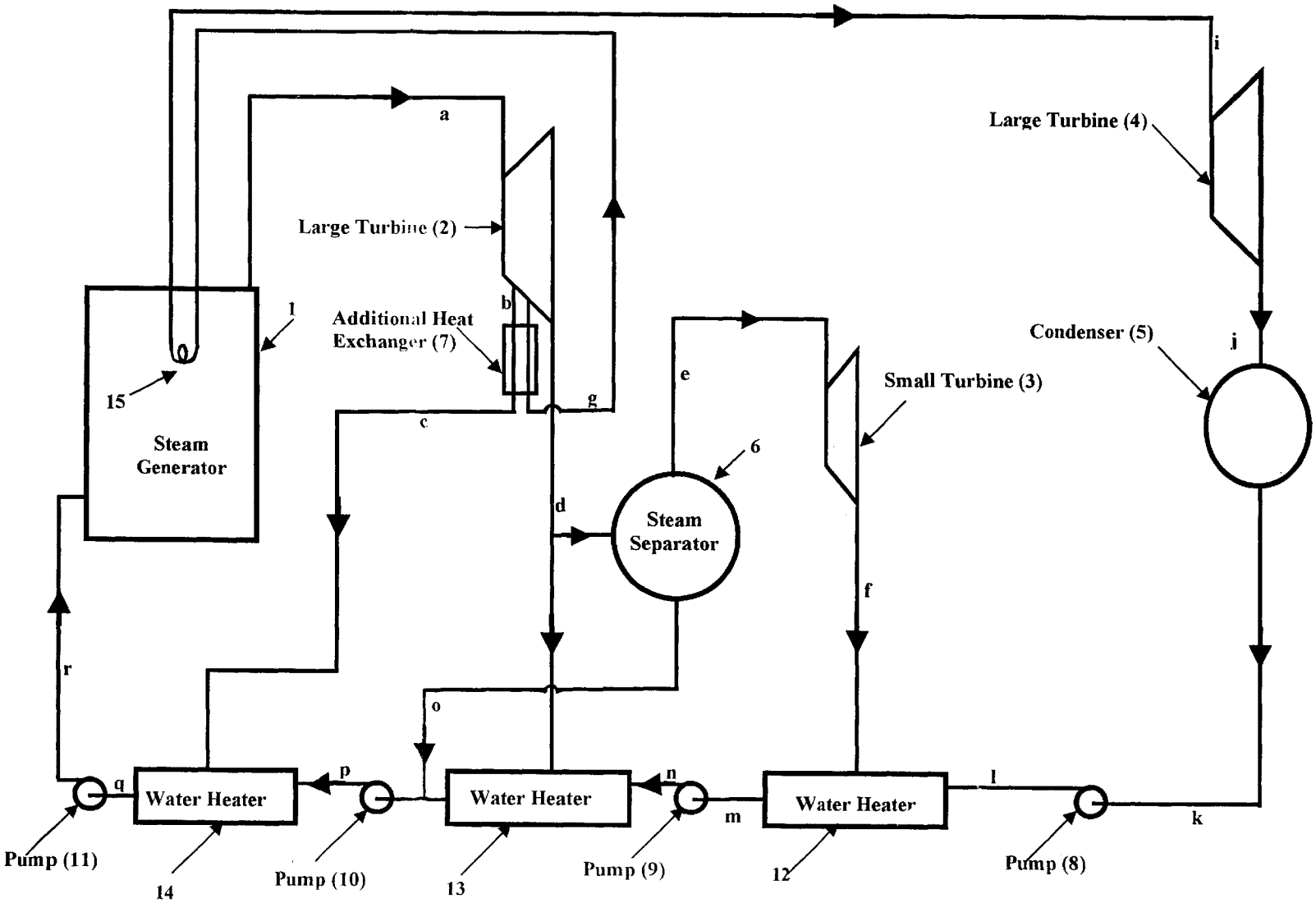
FIG. 1*a* is a schematic diagram of a simple power cycle embodying the invention.
Figure 1B:
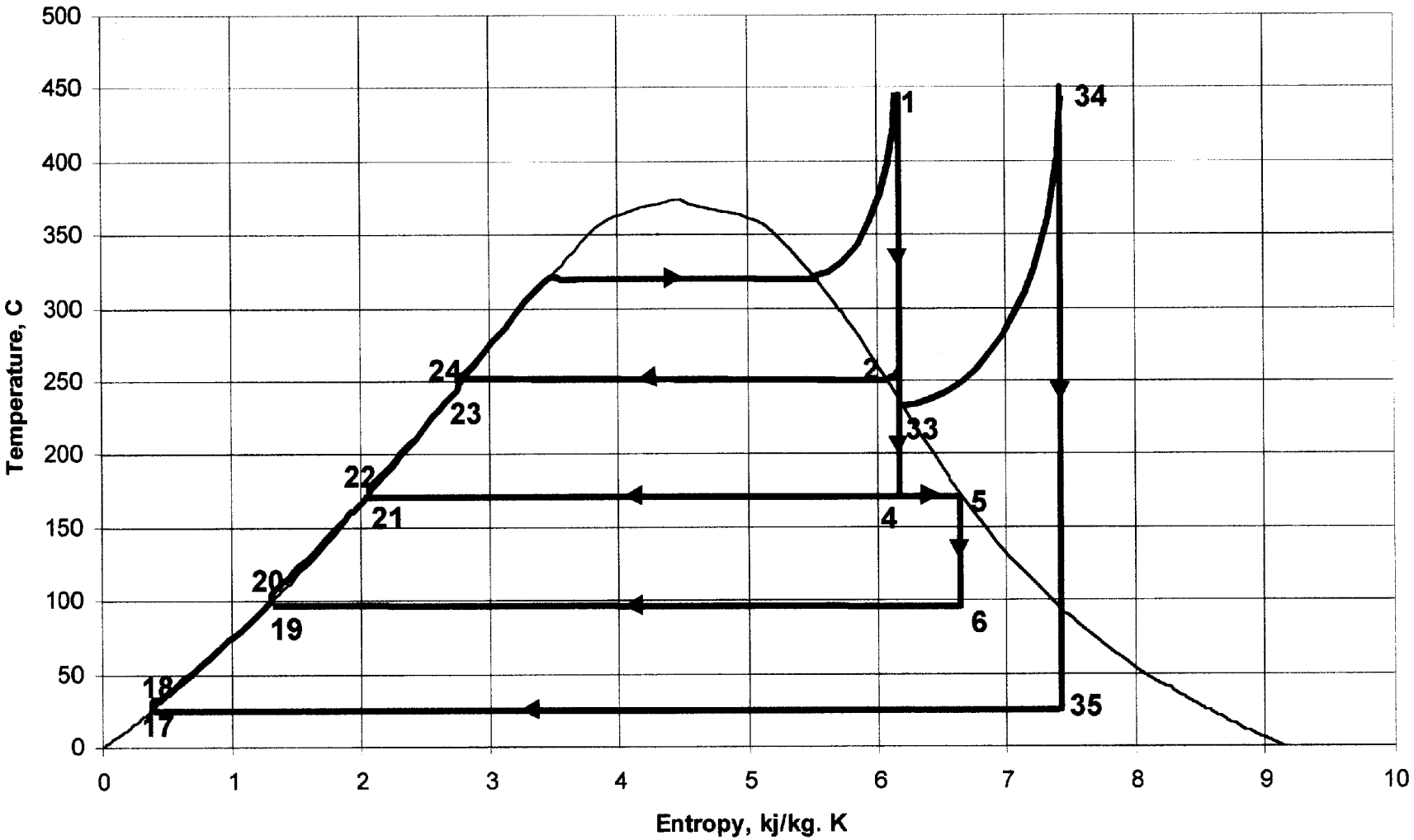
FIG. 1*b* is an illustrative diagram of the cycle shown in FIG. 1*a* as it is ideally represented on a temperature-entropy diagram.

FIG. 1*a* shows a schematic diagram of a cycle that comprises three feed water heaters, three turbines, four water pumps, one steam separator, one steam generator, one condenser, and electric generators. That cycle carries the invention into effect. FIG. 1*b* shows the temperature-entropy diagram of the cycle shown in FIG. 1*a* (with no pressure drops or heat losses). At point a, steam exits steam generator 1, at a superheated condition (about 110 bar and 450° C.) and expands adiapatically to a lower pressure of 40.1 bar at point b, in large turbine 2, where steam still in a superheated condition. Such expansion generates mechanical power that is usually converted to electricity in an electrical generator. It is understood that every step of expansion in a steam turbine produces mechanical power that is converted to electricity using electrical generators. A predetermined amount of superheated steam at point b is extracted from large turbine 2. Such extraction can be done by controlling a valve on an exhaust pipe at a section that corresponds to the pressure at b in large turbine 2. If the superheated steam at b is relatively at high superheat temperature, additional heat exchanger 7 can be used to exchange heat between the superheated steam at b and the saturated steam at g. Steam at point g has a lower pressure than steam at b as shown in FIG. 1*b*. The function of additional heat exchanger 7 is to raise the temperature of the reheated steam at g to a higher temperature at h. Steam at h enters the steam generator 1 for the purpose of reheating. The first function of additional heat exchanger 7 is to reduce the amount of heat added to the reheated steam in steam generator 1, thus increasing the cycle efficiency. The second function of additional heat exchanger is to reduce the temperature difference of heat transfer across water heater 14, thus reducing the irreversibility of water heater 14 and increasing the cycle efficiency. The superheated steam stream that exits additional heat exchanger 7, at point c is at a saturated condition of about 250° C. where it enters water heater 14. Water heater 14 could be closed feed water heater or an open feed water heater (direct contact heater). In such a direct contact heater, saturated steam mixes with the pumped hot water at p (165° C.), resulting in saturated water at a higher temperature of 250° C. at point q (limiting our discussion to only open feed water heaters). Hot water at q is pumped using pump 11 to a relatively higher pressure of 110 bar at r, where hot water enters steam generator 1. The predetermined amount of steam at point b is determined using a heat exchange relation that would result in a saturated water condition at point q (the output of water heater 14). A predetermined amount of steam at almost the same pressure of the water entering feed water heater 13, is extracted from large turbine 2, at point d at a pressure of about 7.1 bar and a two-phase condition. A predetermined portion of the extracted steam at d (about 165° C.) enters feed water heater 13, where it mixes with the pumped hot water at point n (about 100° C.), resulting in a saturated water exiting the heater at point o (162° C.). The remainder amount of wet steam at point d enters steam separator 6 that separates the entering wet steam to two outlets. The first outlet is a down stream of saturated water at point o and the second outlet is an upstream of dry saturated steam at point e. The separation process as all other processes that have been discussed so far is a continuous adiabatic process at almost constant pressure. The steam separator 6 can be located as close as possible to steam turbines to minimize any pressure drops in the steam piping system. The steam separator has two functions. The first function is to allow steam to be extracted in a two-phase region (at a lower temperature difference of heat transfer across water heater 2 than in the case of using superheated steam) for the purpose of the regeneration process in water heater 2. The second function is to allow the dry steam output of the steam separator at point e to be expanded further in small turbine 3. If steam at point d were allowed to expand in small turbine 3 without using the steam separator, the expansion process in small turbine 3 would be very inefficient. The reason for the inefficient expansion is that steam at point d is too wet for an efficient expansion process and needs to be dried in the steam separator first. The reduction of the temperature difference of heat transfer across water heaters reduces the irreversibility of water heaters and increases the cycle efficiency. The saturated steam exiting separator 6 at e enters small turbine 3 where it is expanded adiabatically to a lower pressure of about 0.92 bar at point f. Steam at point f is in a two-phase condition enters water heater 12, where it mixes with the water exiting water pump 8, at point 1 (about 27° C.), resulting in a saturated water exiting water heater 12, at point m (about 97° C.). Saturated water output of steam separator 6 mixes with hot water output of feed water heater 13 at point o. The remainder portion of steam that enters large turbine 2 is expanded adiabatically to an intermediate pressure of about 30 bar (about ¼ of the absolute pressure value at point 1) at point g. If additional heat exchanger 7 was used, steam at point g will be heated to a higher temperature before it enters steam generator 1 to be reheated in reheater tubes 15, at almost constant pressure to a high temperature of about 450° C. at point i. Superheated steam at i is expanded adiabatically to the condenser pressure at point j in large turbine 4. Steam at point j is in a two-phase condition and a vacuum pressure of about 0.033 bar. Condenser 5 is usually water-cooled or air-cooled. It is a heat exchanger unit to condense steam in a continuous manner at almost a constant pressure. Water exiting the condenser at a vacuum pressure at point k is pumped using water pump 8, to a pressure of about 0.91 bar which is the operating pressure of water heater 12. Water exiting water heater 12 at a pressure of about 0.9 bar at point m is pumped using water pump 9, to a pressure of about 7.1 bar which is the operating pressure of water heater 13. Water exiting water heater 13 at a pressure of about 7 bar at point o is pumped using water pump 10, to a pressure of about 40 bar which is the operating pressure of water heater 14. The thermal characteristics of the cycle shown in FIG. 1*a* are ideally represented in FIG. 1*b*, just for the sake of simplicity. It is understood that there will be minor pressure and heat transfer losses and the expansion processes in turbines will not be ideally adiabatic.

To calculate the mass flow rate at each point of a cycle that has seven separator-heater couples, we write the energy balance for the separator-heater couple in a system of 7 separator-heater couples with maximum mass flow rate of unity shown.

$$m_{hn}h_{sni} + \left(1 - \sum_{k=n}^{7} m_{hk} - \sum_{k=n}^{7} m_{sk}\right)h_{hni} = \left(1 - \sum_{k=n+1}^{7} m_{hk} - \sum_{k=n}^{7} m_{sk}\right)h_{hno} \quad (1)$$

$$\left(\sum_{k=1}^{n-1} m_{hk} + \sum_{k=1}^{n-1} m_{sk}\right)h_{sno} + m_{sn}h_{hno} = \left(\sum_{k=1}^{n-1} m_{hk} + \sum_{k=1}^{n} m_{sk}\right)h_{sni} \quad (2)$$

Equation 1 is written for heater numbers n and Equation 2 for separator number n in a system of 7 heaters-separators where h is specific enthalpy [j/kg], m mass flow rate [kg/sec], and the subscripts hk is heater number k, hn is heater number n, sk is separator number k, sn is separator number n, hni is inlet to heater number n, hno is outlet of heater number n, sni is inlet to separator number n, sno is outlet of separator number n. Solving Equations 1 and 2 for each set of separator-heater simultaneously, we obtain the mass flow rates since the enthalpy at each point is known.

Figure 2A:
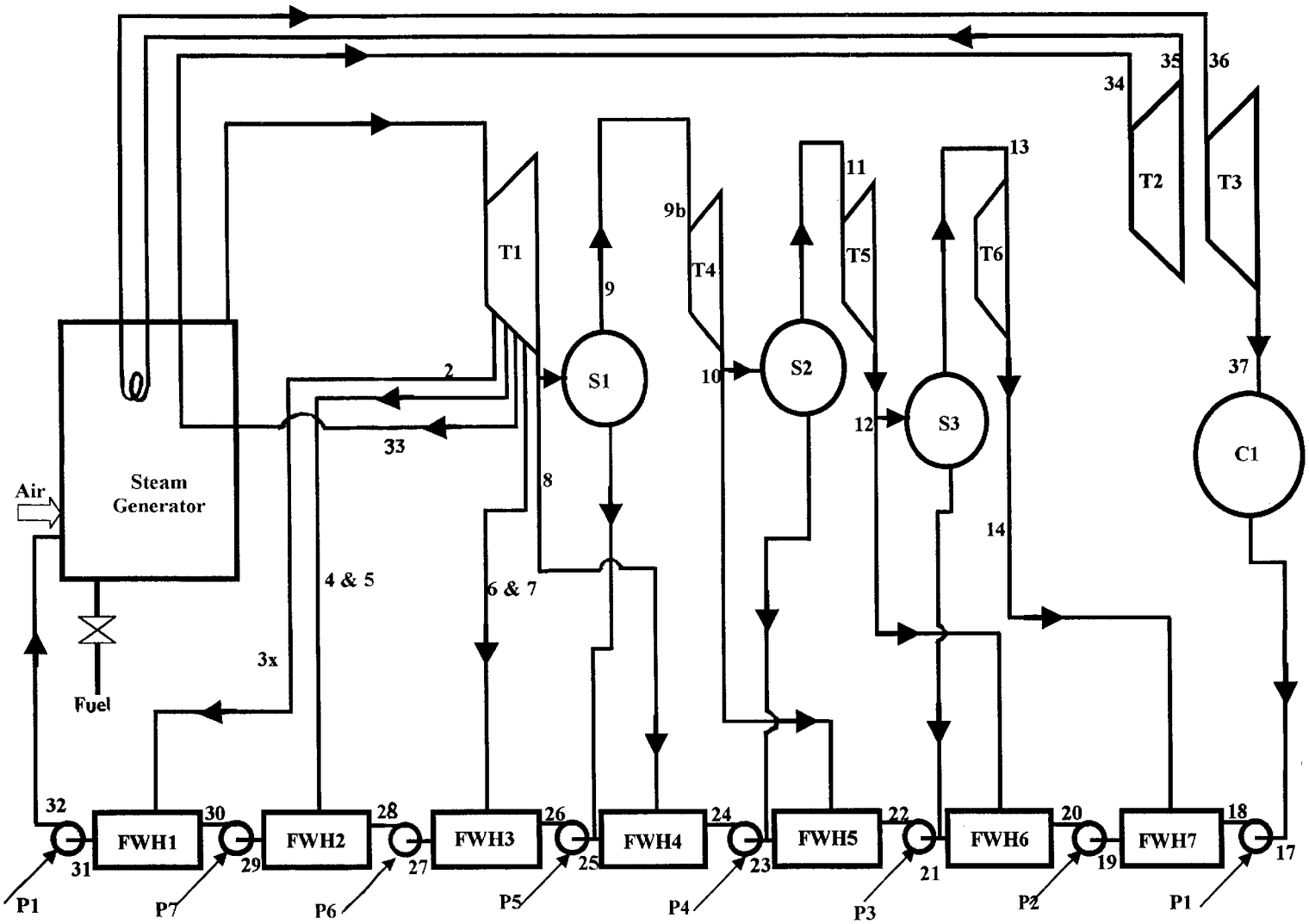
FIG. 2*a* is a schematic diagram of a steam power cycle in a system employing a plurality of turbines, feed heaters, pumps, and separators and embodying the invention.
Figure 2B:
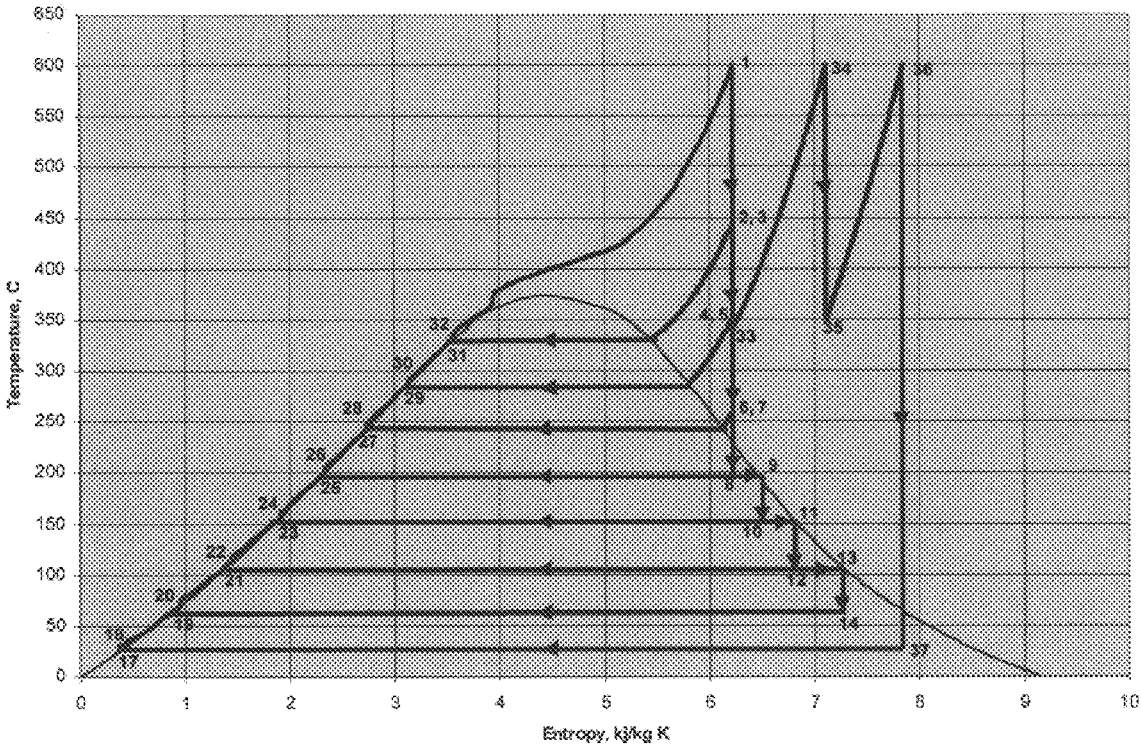
FIG. 2*b* is an illustrative diagram of the cycle shown in FIG. 2*a* as it is ideally represented on a temperature-entropy diagram.

FIG. 2*a* shows a schematic diagram of a system that comprises 3 large scale turbines (T1, T2, & T3), 3 small scale turbines (T4, T5 & T6), 7 feed water heaters (FWH1, FWH2, FWH3, FWH4, FWH4, FWH5, FWH6 & FWH7), 3 steam separators (S1, S2 & S3), one condenser (C1), one steam generator, 8 water pumps (P1, P2, P3, P4, P5, P6, P7 & P8), and electrical generators. FIG. 2*b* shows the thermal characteristics of the cycle shown in FIG. 2*a* on the temperature-entropy diagram. The thermal characteristics of the cycle are ideally represented on the temperature-entropy diagram (with no pressure drops or heat losses). Such a cycle carries the invention into effect. Steam exiting the steam generator at point 1 (a temperature of about 600° C. and a pressure of about 300 bar) is expanded in large turbine T1 continuously and adiabatically to lower pressures providing mechanical power that is converted usually to electricity using an electrical generator. The amount of steam needed to heat the hot water at point 30 in feed water heater FWH1 to point 31 is extracted from large turbine T1 at a pressure of about 130.1 bar. The conditions at point 30 are a pressure of about 130 bar and a temperature of about 286° C. At point 31, hot water is at almost the same pressure, but at 330° C. (saturated condition). The amount of steam needed to heat the hot water at point 28 in feed water heater FWH2 to point 29 is extracted from large turbine T1 at a pressure of about 70.1 bar. The conditions at point 28 are a pressure of about 71 bar and a temperature of about 242° C. At point 29, hot water is at almost the same pressure, but at 286° C. (saturated condition). The amount of steam needed to heat the hot water at point 26 in feed water heater FWH3 to point 27 is extracted from large turbine T1 at a pressure of about 35.55 bar. The conditions at point 26 are a pressure of about 35.45 bar and a temperature of about 201° C. At point 27, hot water is at almost the same pressure, but at 242° C. (saturated condition). The amount of steam needed to heat the hot water that enters feed water heaters FWH4, FWH5, FWH6, and FWH7 is expanded adiabatically and continuously in large steam turbine T1 to pressure of 15.7 bar at point 8. The amount of steam needed to heat the hot water at point 24 in feed water heater FWH4 to point 25 is extracted from large turbine T1 at a pressure of about 15.75 bar. The conditions at point 24 are a pressure of about 15.65 bar and a temperature of about 158° C. At point 25, hot water is at almost the same pressure, but at 201° C. (saturated condition). Equations 1 and 2 can be used to determine the mass flow rates entering every steam separator and feed water heater. By adding the mass flow rate entering separator S1 to that entering feed water heater FWH4, the mass flow rate to be extracted from large turbine T1 at point 8 can be determined as $m_8$. By adding the mass flow rates of steam extracted at points 2, 4, and 6 to $m_8$, the total mass flow rate of steam extracted from large turbine T1 can be determined as $m_e$. By subtracting $m_e$ from the mass flow rate entering large turbine T1 at point 1, the mass flow rate that is expanded adiabatically to a pressure of about 66 bar at point 33 can be determined. At point 33, steam returns to the steam generator for reheating at almost a constant pressure of 66 bar to a high temperature of 600° C. At point 34, steam enters large turbine T2 and expands adiabatically and continuously to a pressure of about 14.5 bar and a temperature of about 374° C. at point 35 producing mechanical power that is usually converted to electricity in an electrical generator. Steam exiting large turbine T2 enters the steam generator for a second stage of reheating at almost constant pressure to a temperature of about 600° C. at point 36. The reheated steam at point 36 enters large turbine T3 to expand continuously and adiabatically to a vacuum pressure of about 0.033 bar at point 37. Steam at point 37 enters steam condenser C1 where usually water or air is used to condense the steam in a continuous process at a constant pressure to water at vacuum pressure at point 17. Water at 17 is pumped in a continuous process to a pressure of about 0.306 bar at point 18 where water enters feed water heater FWH7. The rest of steam that is expanded adiabatically and continuously in large turbine T1 at point 8 enters steam separator S1 after satisfying the required steam for feed water heater FWH4. In steam separator S1, steam is separated in a continuous process adiabatically and at almost constant pressure to two outlets. The first outlet is dry saturated steam, leaving the top of separator S1 at point 9 at a pressure of 15.7 bar. The second outlet is saturated water leaving the bottom of separator S1 at the same pressure of 15.7 bar where it joins the hot water exiting feed water heater FWH4 at point 25. Dry steam at point 9 is expanded adiabatically and continuously in small turbine T4 to a pressure of about 5.8 bar at point 10 to produce mechanical power that is usually converted to electricity using an electrical generator. The amount of steam needed to heat the hot water at point 22 (at a pressure of about 5.78 bar and a temperature of about 112° C.) in feed water heater FWH5 to point 23 is drawn from the steam entering separator S2 at point 10. At point 23 the hot water exiting the heater is at almost the same pressure, but at a temperature of 158° C. The rest of steam that exits small turbine T4 at point 10 enters separator S2 where steam is separated in a continuous process adiabatically and at almost a constant pressure to two outlets. The first outlet is dry saturated steam, leaving the top of separator S2 at point 11 at a pressure of 5.8 bar. The second outlet is saturated water leaving the bottom of separator S2 at the same pressure of 5.8 bar where it joins the hot water exiting feed water heater FWH5 at point 23. Dry steam at point 11 is expanded adiabatically and continuously in small turbine T5 to a pressure of about 1.57 bar at point 12 to produce mechanical power that is usually converted to electricity using an electrical generator. The amount of steam needed to heat the hot water at point 20 (at a pressure of about 1.57 bar and a temperature of about 70° C.) in feed water heater FWH6 to point 21 is drawn from the steam entering separator S3 at point 12. At point 21 the hot water exiting the heater is at almost the same pressure, but at a temperature of 112° C. The rest of steam that exits small turbine T5 at point 12 enters separator S3 where steam is separated in a continuous process adiabatically and at almost constant pressure to two outlets. The first outlet is dry saturated steam, leaving the top of separator S3 at point 13 at a pressure of 1.57 bar. The second outlet is saturated water leaving the bottom of separator S3 at the same pressure of 1.57 bar where it joins the hot water exiting feed water heater FWH6 at point 21. Dry steam at point 13 is expanded adiabatically and continuously in small turbine T6 to a pressure of about 0.307 bar at point 14 to produce mechanical power that is usually converted to electricity using an electrical generator. The amount of steam needed to heat the hot water at point 18 (at a pressure of about 0.306 bar and a temperature of about 27° C.) in feed water heater FWH7 to point 19 is drawn from the steam exiting small turbine T6 at point 14. At point 19 the hot water exiting the heater is at almost the same pressure, but at a temperature of 70° C. FIG. 2*b* shows the thermal characteristics of the cycle shown in FIG. 2*a* as they are represented ideally on the temperature-entropy diagram.

Figure 3:
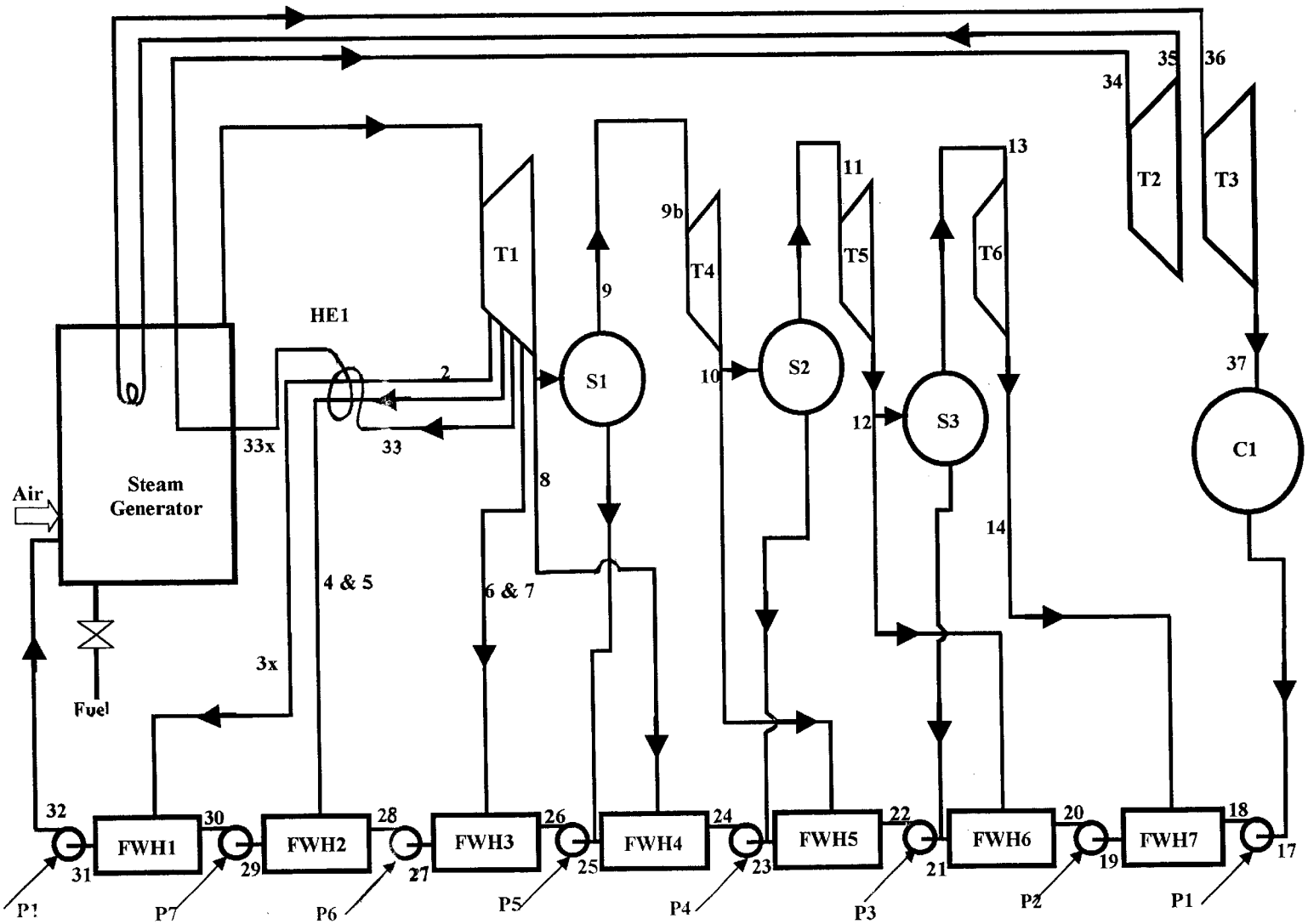
FIG. 3 is a schematic diagram similar to FIG. 2*a* showing a second arrangement of a steam power cycle in a system employing a plurality of turbines, feed heaters, pumps, and separators and embodying the invention.
Figure 4:
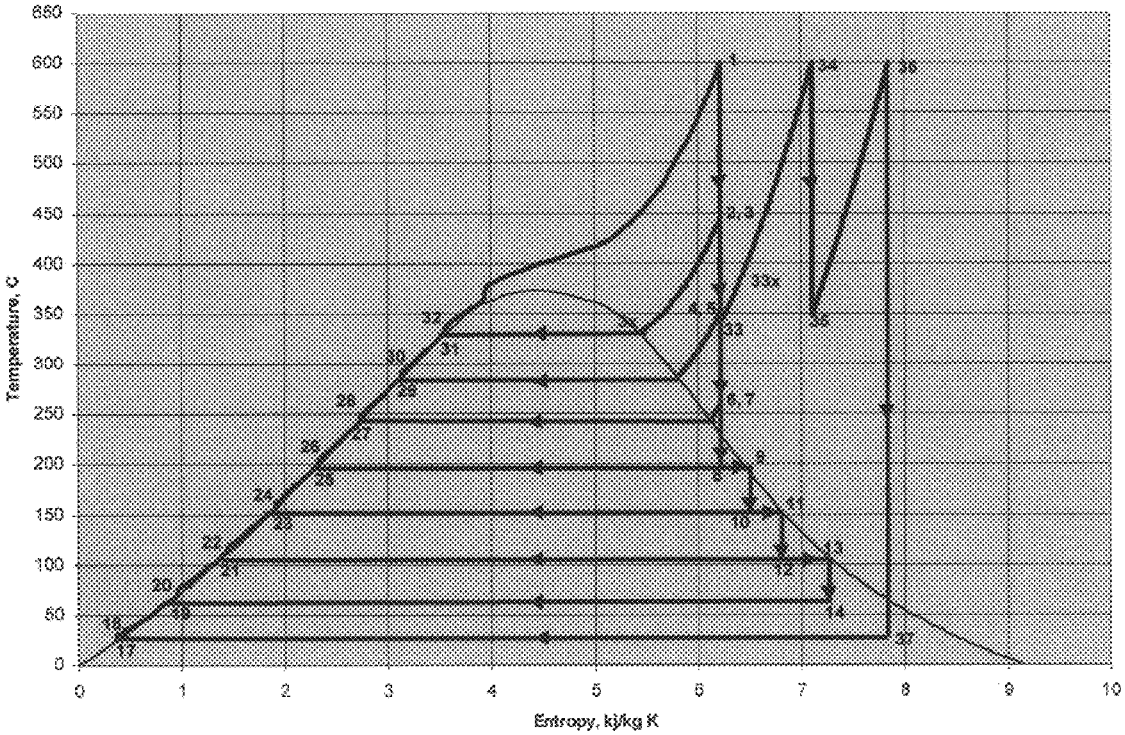
FIG. 4 is an illustrative diagram of the cycle shown in FIG. 3 as it is ideally represented on a temperature-entropy diagram.

FIG. 3 shows the exact same cycle that is shown in FIG. 2*a* except that there is an additional heat exchanger to reduce the superheat temperature of the superheated steam at 2 extracted from large turbine T1 for the purpose of heating the hot water of feed heater FWH1. As the superheated steam at 2 is cooled as it passes through heat exchanger HE1, the steam extracted from large turbine T1 at point 33 is heated as it passes through heat exchanger HE1 to a temperature of about 392° C. at point 33*x*. The conditions at point 2 are a pressure of about 129.7 bar and a temperature of about 455° C. The conditions at point 33 are a temperature of about 357° C. and at a lower pressure than that at point 2. The superheated steam at 2 that enters heat exchanger HE1 exits the heat exchanger at point 3*x* where its temperature is about 367° C. FIG. 4 shows the thermal characteristics of the cycle shown in FIG. 3 as they are represented ideally on the temperature-entropy diagram.

Figure 5:
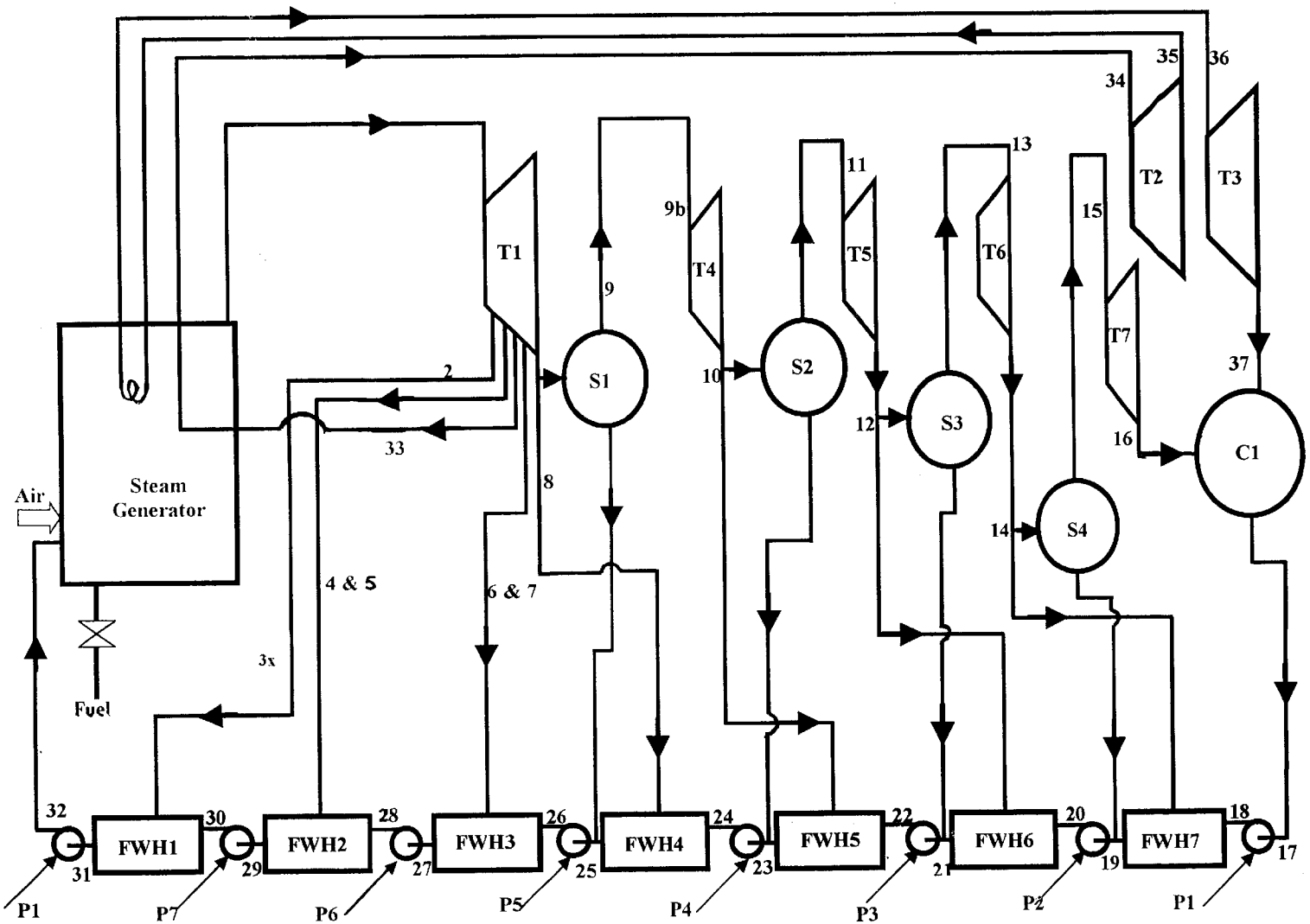
FIG. 5 is a schematic diagram similar to FIG. 3 showing a third arrangement of a steam power cycle in a system employing a plurality of turbines, feed heaters, pumps, and separators and embodying the invention.
Figure 6:
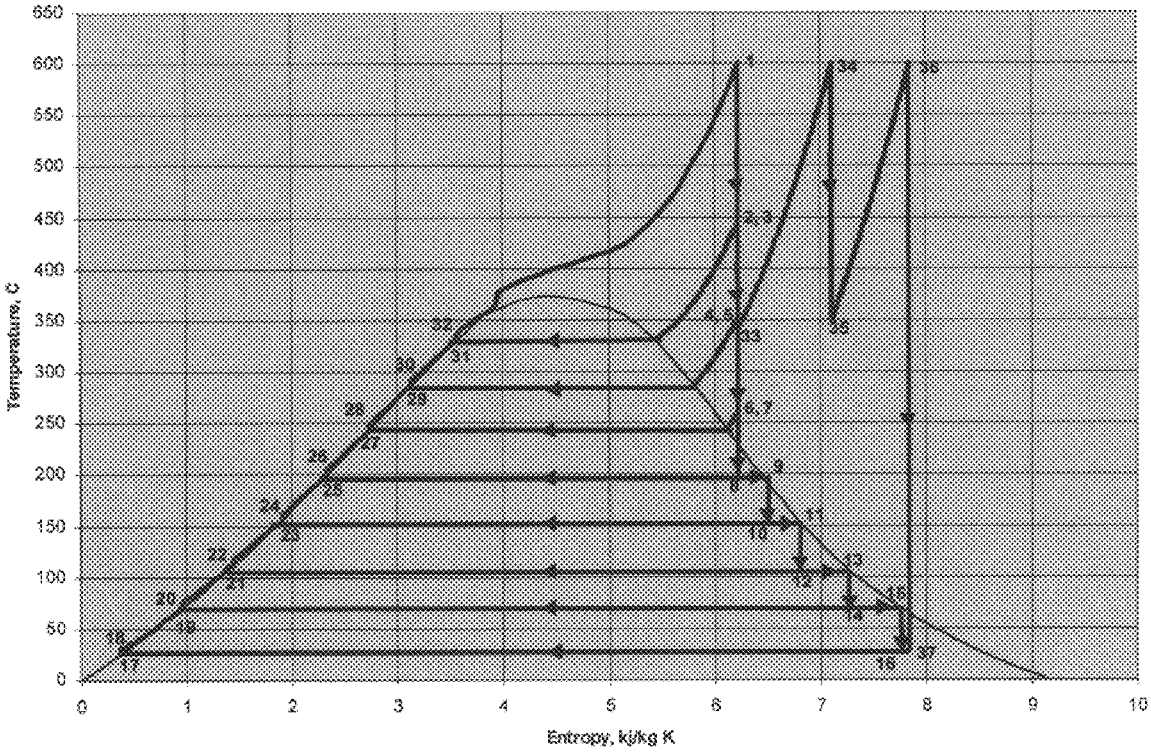
FIG. 6 is an illustrative diagram of the cycle shown in FIG. 5 as it is ideally represented on a temperature-entropy diagram.

FIG. 5 shows a schematic diagram of the exact same cycle that is shown in FIG. 2*a* except that there is an additional steam separator and a stage of expansion in a small steam turbine. The mass flow rate of steam that expands in small turbine T7 will affect the mass flow rate of the reheater pipes so that such mass of small turbine T7 can be chosen to maximize cycle efficiency or output power whatever is required. Determining such a mass flow rate, the mass flow rate of the two-phase steam that enters separator S4 can be determined. Dry steam exits the top of separator S4 at point 15 (at a temperature of about 70° C. saturated condition) to enters small turbine T7 to expand to the condenser pressure. Steam exiting small turbine T7 enters condenser C1 to be condensed at a vacuum pressure. As steam expands in small turbine T7 to produce mechanical power that is usually converted to electricity using an electrical generator. Separator S4 converts the inlet two-phase steam to two outlets adiabatically, continuously and at almost a constant pressure. The first outlet is dry steam at the top of the separator at point 15 and the second outlet is saturated water out of the bottom of the separator at point 19 that joins the hot water outlet of feed heater FWH7. The amount of steam needed to heat the hot water at point 18 (at a pressure of about 0.306 bar and a temperature of about 27° C.) in feed water heater FWH7 to point 19 is drawn from the steam entering separator S4 at point 14. At point 19 the hot water exiting the heater is at almost the same pressure, but at a temperature of about 70° C. The rest of steam that exits small turbine T6 at point 14 enters separator S4. FIG. 6 shows the thermal characteristics of the cycle shown in FIG. 5 as they are represented ideally on the temperature-entropy diagram.

Figure 7:
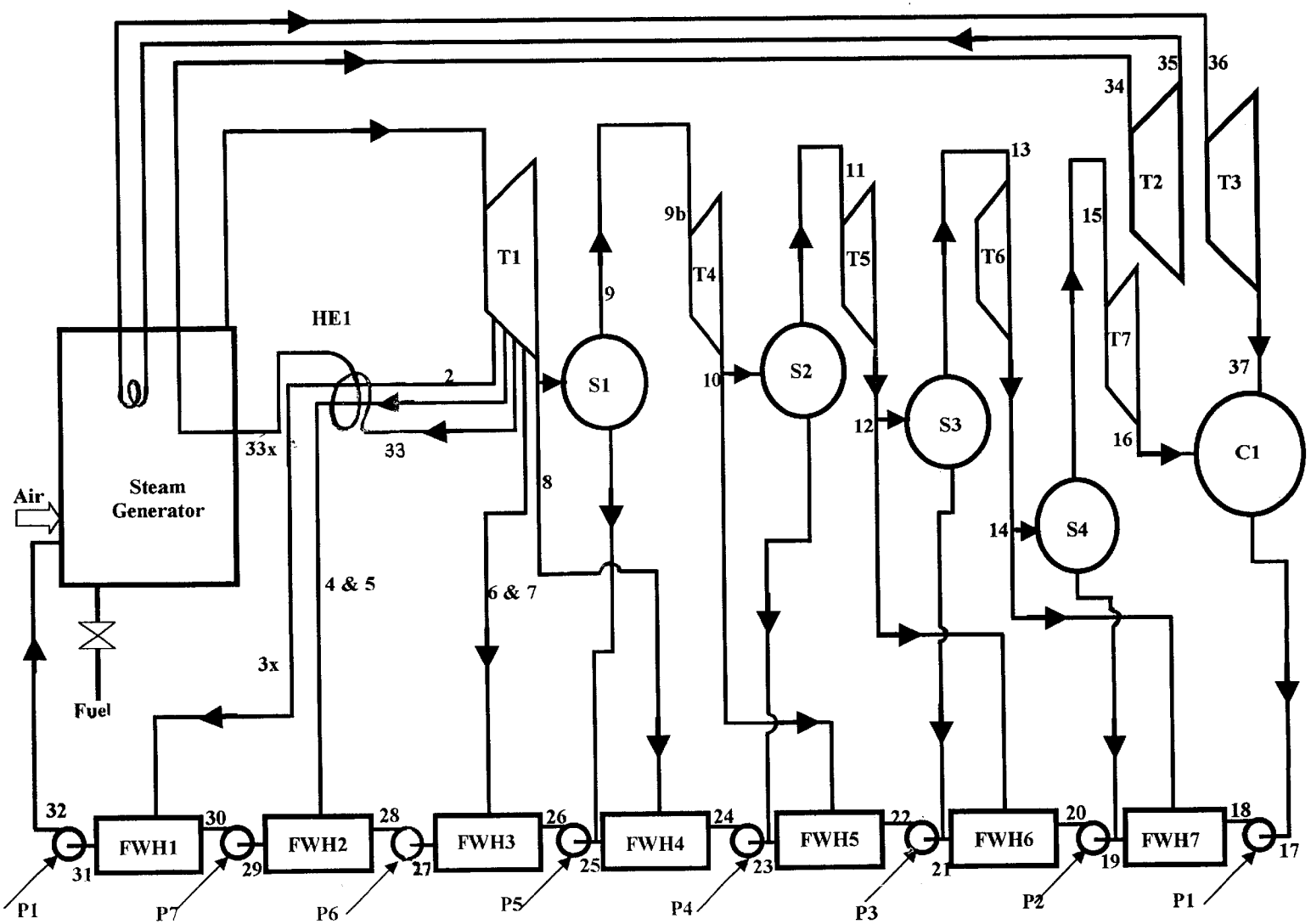
FIG. 7 is a schematic diagram similar to FIG. 3 showing a fourth arrangement of a steam power cycle in a system employing a plurality of turbines, feed heaters, pumps, and separators and embodying the invention.
Figure 8:
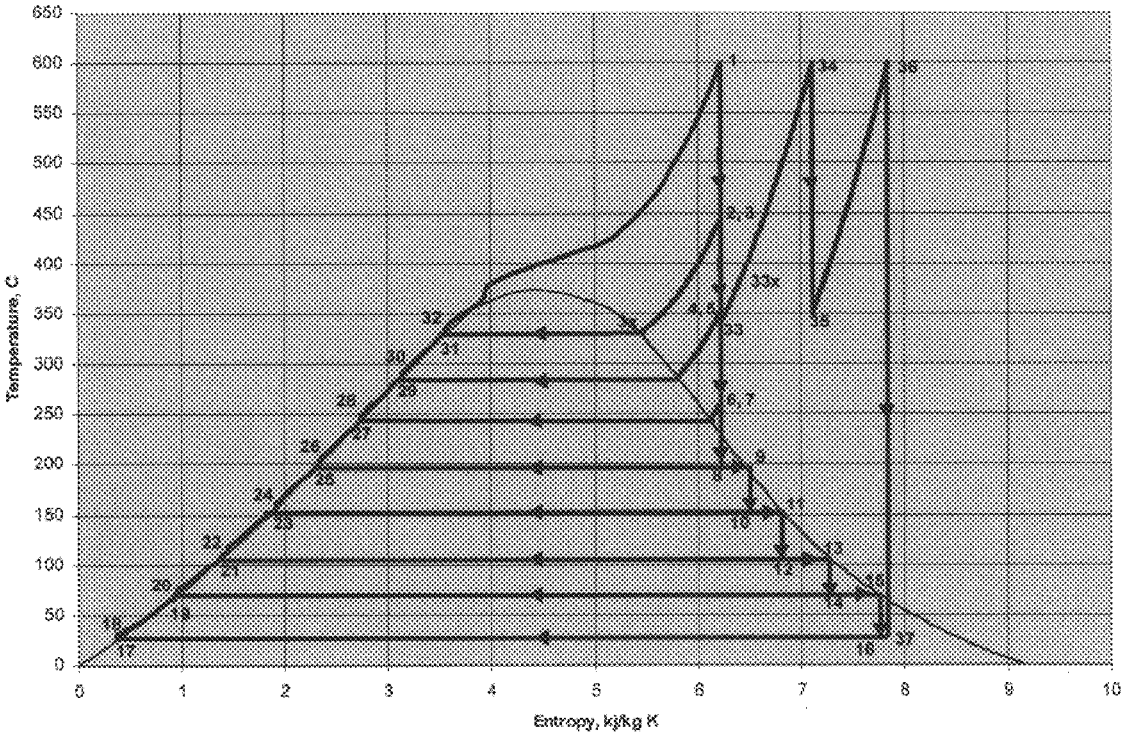
FIG. 8 is an illustrative diagram of the cycle shown in FIG. 7 as it is ideally represented on a temperature-entropy diagram.

FIG. 7 shows the exact same cycle that is shown in FIG. 5 except that there is an additional heat exchanger to reduce the superheat temperature of the superheated steam at 2 that is extracted from large turbine T1 for the purpose of heating the hot water of feed heater FWH1. As the superheated steam at 2 is cooled as it passes through heat exchanger HE 1, the steam extracted from large turbine T1 at point 33 is heated as it passes through heat exchanger HE1 to a temperature of about 392° C. at point 33*x*. The conditions at point 2 are a pressure of about 129.7 bar and a temperature of about 455° C. The conditions at point 33 are a temperature of about 357° C. and at a lower pressure than that at point 2. The superheated steam at 2 that enters heat exchanger HE1 exits the heat exchanger at point 3*x* where its temperature is about 367° C. FIG. 8 shows the thermal characteristics of the cycle shown in FIG. 7 as they are represented ideally on the temperature-entropy diagram.

Figure 9B:
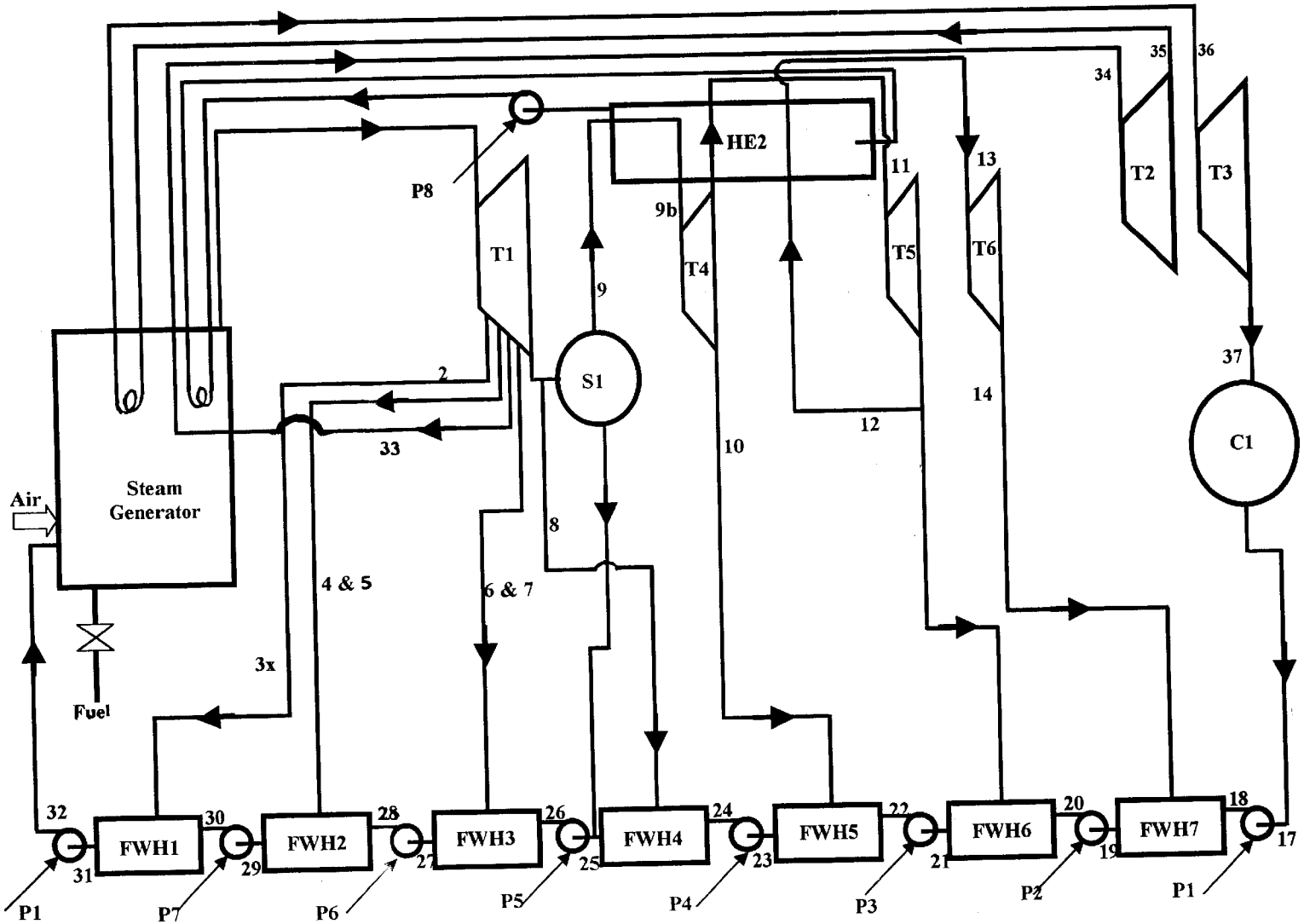
FIG. 9*b* is a schematic diagram showing a fifth arrangement of a steam power cycle in a system employing a plurality of turbines, feed heaters, pumps, and separators and embodying the invention.
Figure 10:
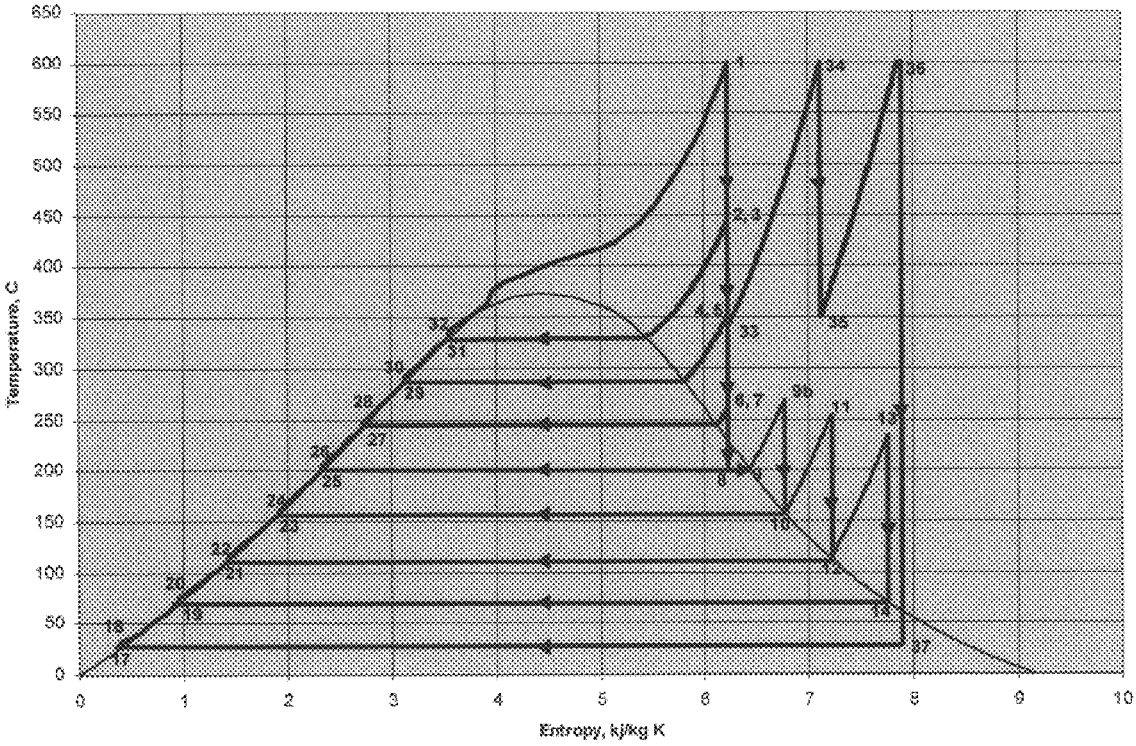
FIG. 10 is an illustrative diagram of the cycle shown in FIG. 9*b* as it is ideally represented on a temperature-entropy diagram.

FIG. 9*b* shows a schematic diagram of a cycle that is composed of 3 large scale turbines (T1, T2, & T3), 3 small scale turbines (T4, T5 & T6), 7 feed water heaters (FWH1, FWH2, FWH3, FWH4, FWH4, FWH5, FWH6 & FWH7), a condenser (C1), a steam generator, 8 water pumps (P1, P2, P3, P4, P5, P6, P7 & P8), a multi-pass heat exchanger and electrical generators. FIG. 10 shows the thermal characteristics of the cycle shown in FIG. 10 on the temperature-entropy diagram. Such a cycle carries the invention into effect. Steam exiting the steam generator at point 1 (a temperature of about 600° C. and a pressure of about 300 bar) is expanded in large turbine T1 continuously and adiabatically to lower pressures providing mechanical power that is converted usually to electricity using an electrical generator. The amount of steam needed to heat the hot water at point 30 in feed water heater FWH1 is extracted from large turbine T1 at a pressure of about 130.1 bar (point 2). The conditions at point 30 are a pressure of about 130 bar and a temperature of about 286° C. Hot water in FWH1 is heated to point 31 where hot water is at almost the same pressure, but at 330° C. (saturated condition). The amount of steam needed to heat the hot water at point 28 in feed water heater FWH2 is extracted from large turbine T1 at point 4 at a pressure of about 70.1 bar. The conditions at point 28 are a pressure of about 71 bar and a temperature of about 242° C. Hot water in FWH2 is heated to point 29 where hot water is at almost the same pressure, but at 286° C. (saturated condition). The amount of steam needed to heat the hot water at point 26 in feed water heater FWH3 is extracted from large turbine T1 at a pressure of about 35.55 bar (point6). The conditions at point 26 are a pressure of about 35.45 bar and a temperature of about 201° C. Hot water in FWH3 is heated to point 27 where hot water is at almost the same pressure, but at 242° C. (saturated condition). The amounts of steam needed to heat the hot water that enters feed water heaters FWH4, FWH5, FWH6, and FWH7 are added and denoted as $m_9$. By applying the energy and mass balance equations on separator S1, the mass flow rate-entering separator S1 can be determined as $m_{s1}$. The amount of steam needed to heat the hot water at point 24 in feed water heater FWH4 to point 25 is extracted from large turbine T1 at a pressure of about 15.75 bar and can be determined as $m_{FWH4}$. The conditions at point 24 are a pressure of about 15.65 bar and a temperature of about 158° C. At point 25, hot water at almost the same pressure, but at 201° C. (saturated condition). By adding $m_{s1}$ to $m_{FWH4}$, the mass flow rate that is expanded adiabatically and continuously in large steam turbine T1 to a pressure of 15.7 bar at point 8 can be determined as $m_8$. By adding $m_8$ to the mass flow rates extracted at 2, 4, and 6, the total mass flow rate extracted for the purpose of regeneration can be determined as $m_e$. By subtracting me from the mass flow rate that enters large turbine T1 at 1, the mass flow rate that expands adiabatically to a pressure of about 66 bar at point 33 can be determined. At point 33, steam returns to the steam generator for reheating at almost a constant pressure of 66 bar to a high temperature of 600° C. At point 34, steam enters large turbine T2 and expands adiabatically and continuously to a pressure of about 14.5 bar at point 35 producing mechanical power that is usually converted to electricity in an electrical generators. Steam exiting large turbine T2 enters the steam generator for a second stage of reheating at almost constant pressure to a temperature of about 600° C. at point 36. The reheated steam at point 36 enters large turbine T3 to expand continuously and adiabatically to a vacuum pressure of about 0.033 bar at point 37. Steam at point 37 enters steam condenser C1 where usually water or air is used to condense steam in a continuous process at a constant pressure to water at vacuum pressure at point 17. Water at 17 is pumped in a continuous process to a pressure of about 0.306 bar at point 18 where water enters feed water heater FWH7. The rest of steam that is expanded adiabatically and continuously in large turbine T1 at point 8 after satisfying the required steam for feed water heater FWH4 enters steam separator S1. In steam separator S1, steam is separated in a continuous process adiabatically and at almost a constant pressure to two outlets. The first outlet is dry saturated steam, leaving the top of separator S1 at point 9 at a pressure of 15.7 bar. The second outlet is saturated water leaving the bottom of separator S1 at the same pressure of 15.7 bar where it joins the hot water exiting feed water heater FWH4 at point 25. Dry steam at point 9 is expanded adiabatically and continuously in small turbine T4 to a pressure of about 5.8 bar at point 10 to produce mechanical power that is usually converted to electricity using an electrical generator. The amount of steam needed to heat the hot water at point 22 in feed water heater FWH5 to point 23 is drawn from the steam exiting small turbine T4. The conditions at point 22 are a pressure of about 5.78 bar and a temperature of about 112° C. In heat exchanger HE2 steam is reheated for the purpose of a more efficient expansion in the following stage of expansion. Steam exits multi-pass heat exchanger HE2 at point 11 in a superheated condition where it enters small turbine T5 to be expanded to a lower pressure adiabatically and continuously to produce mechanical power that is usually converted to electricity using an electrical generator. The amount of steam needed to heat the hot water at point 20 (at a pressure of about 1.57 bar and a temperature of about 70° C.) in feed water heater FWH6 to point 21 is drawn from the steam entering heat exchanger HE2 at point 12. At point 21 the hot water exiting the heater is at almost the same pressure, but at a temperature of 112° C. The rest of steam that exits small turbine T5 at point 12 enters multi-pass heat exchanger HE2 where steam is reheated in a continuous process adiabatically and at almost a constant pressure to superheated steam, leaving the heat exchanger at point 13 at a pressure of 1.57 bar. Superheated steam at point 13 is expanded adiabatically and continuously in small turbine T6 to a pressure of about 0.307 bar at point 14 to produce mechanical power that is usually converted to electricity using an electrical generator. The amount of steam needed to heat the hot water at point 18 (at a pressure of about 0.306 bar and temperature of about 27° C.) in the feed water heater FWH7 to point 19 is drawn from the steam exiting small turbine T6 at point 14. At point 19 the hot water exiting the heater is at almost the same pressure, but at a temperature of 70° C. FIG. 10 shows the thermal characteristics of the cycle shown in FIG. 9*b* as they are represented ideally on the temperature-entropy diagram.

Figure 11:
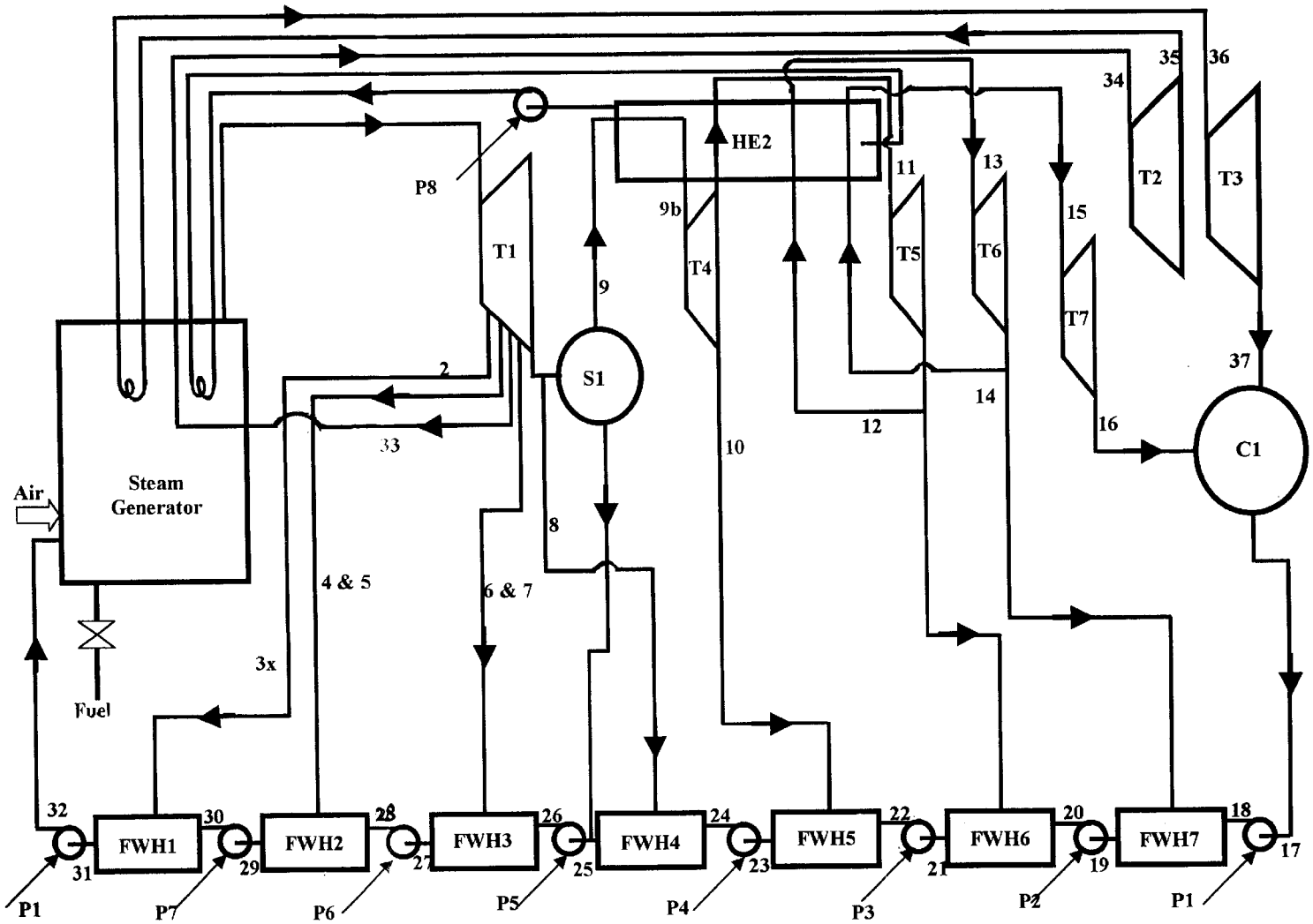
FIG. 11 is a schematic diagram similar to FIG. 9*b* showing a sixth arrangement of a steam power cycle in a system employing a plurality of turbines, feed heaters, pumps, and separators and embodying the invention.
Figure 12:
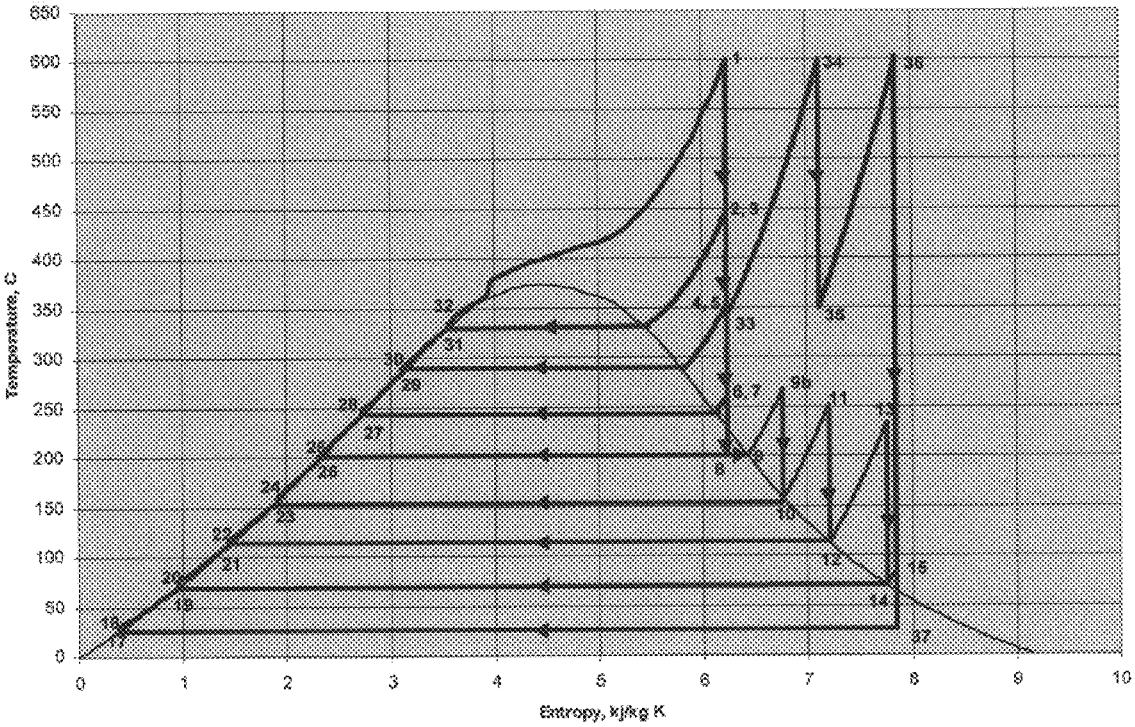
FIG. 12 is an illustrative diagram of the cycle shown in FIG. 11 as it is ideally represented on a temperature-entropy diagram.

FIG. 11 shows a schematic diagram of the exact same cycle that is shown in FIG. 9*b* except that there is an additional pass in multi-pass heat exchanger HE2 to reheat the steam exiting small turbine T5 and a stage of expansion in small steam turbine T6. The mass flow rate of steam that expands in small turbine T7 will affect the mass flow rate of the regular reheater pipes so that such a mass flow rate through small turbine T7 can be chosen to maximize cycle efficiency or output power whatever is required. Determining such a mass flow rate, the mass flow rate of the two-phase steam that enters the final passage of multi-pass heat exchanger HE2 at point 14 can be determined. Superheated steam exits heat exchanger HE2 at point 15 (at a temperature of about 70° C. and saturated condition) to enters small turbine T7 to expand to the condenser pressure. Steam exiting small turbine T7 enters condenser C1 to be condensed at a vacuum pressure. As steam expands in small turbine T7 to produce mechanical power that is usually converted to electricity using an electrical generator. The amount of steam needed to heat the hot water at point 18 (at a pressure of about 0.306 bar and temperature of about 27° C.) in feed water heater FWH7 to point 19 is drawn from the steam entering multi-pass heat exchanger at point 14. At point 19 the hot water exiting the heater is at almost the same pressure, but at a temperature of about 70° C. The rest of steam that exits small turbine T6 at point 14 enters multi-pass heat exchanger HE2. FIG. 12 shows the thermal characteristics of the cycle shown in FIG. 11 as they are represented ideally on the temperature-entropy diagram.

Figure 13:
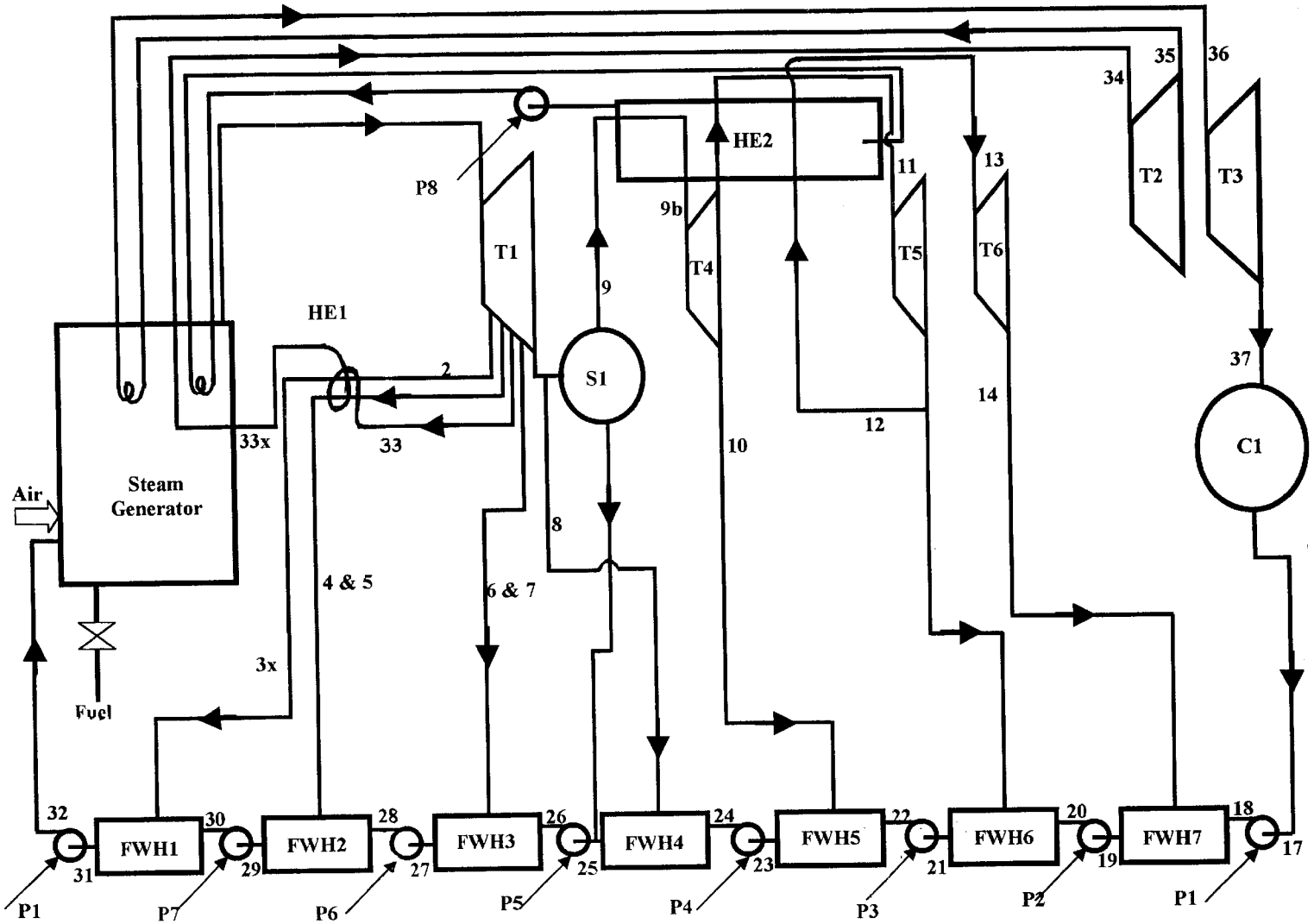
FIG. 13 is a schematic diagram similar to FIG. 9*b* showing a seventh arrangement of a steam power cycle in a system employing a plurality of turbines, feed heaters, pumps, and separators and embodying the invention.
Figure 14:
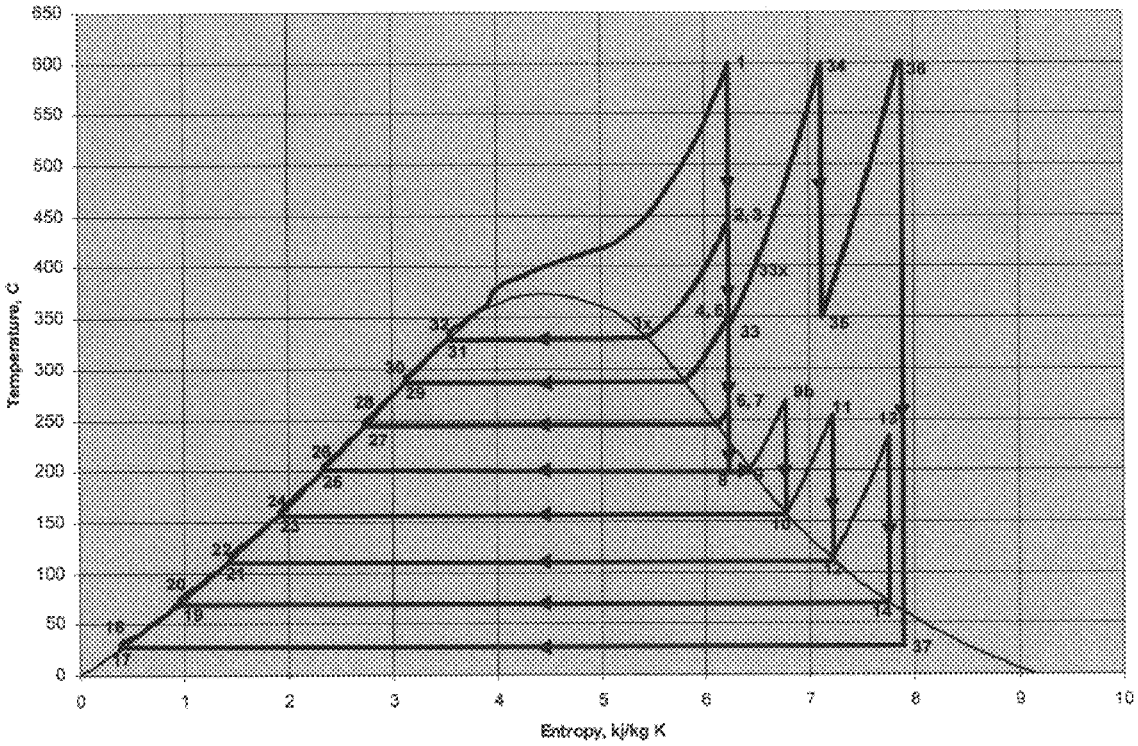
FIG. 14 is an illustrative diagram of the cycle shown in FIG. 13 as it is ideally represented on a temperature-entropy diagram.

FIG. 13 shows the exact same cycle that is shown in FIG. 9*b* except that there is an additional heat exchanger to reduce the superheat temperature of the superheated steam at 2. Steam at point 2 is extracted from large turbine T1 for the purpose of heating the hot water of feed heater FWH1. The conditions at 2 are a pressure of about 129.7 bar and a temperature of about 455° C. As the superheated steam at 2 is cooled as it passes through heat exchanger HE1, the steam extracted from large turbine T1 at point 33 is heated as it passes through heat exchanger HE1 to a temperature of about 392° C. The conditions at point 33*x* are a temperature of about 357° C. and at a lower pressure than that at point 2. The superheated steam at 2 that enters heat exchanger HE1 exits the heat exchanger at point 3*x* where its temperature is about 367° C. FIG. 14 shows the thermal characteristic of the cycle shown in FIG. 13 as they are represented ideally on the temperature-entropy diagram.

Figure 15:
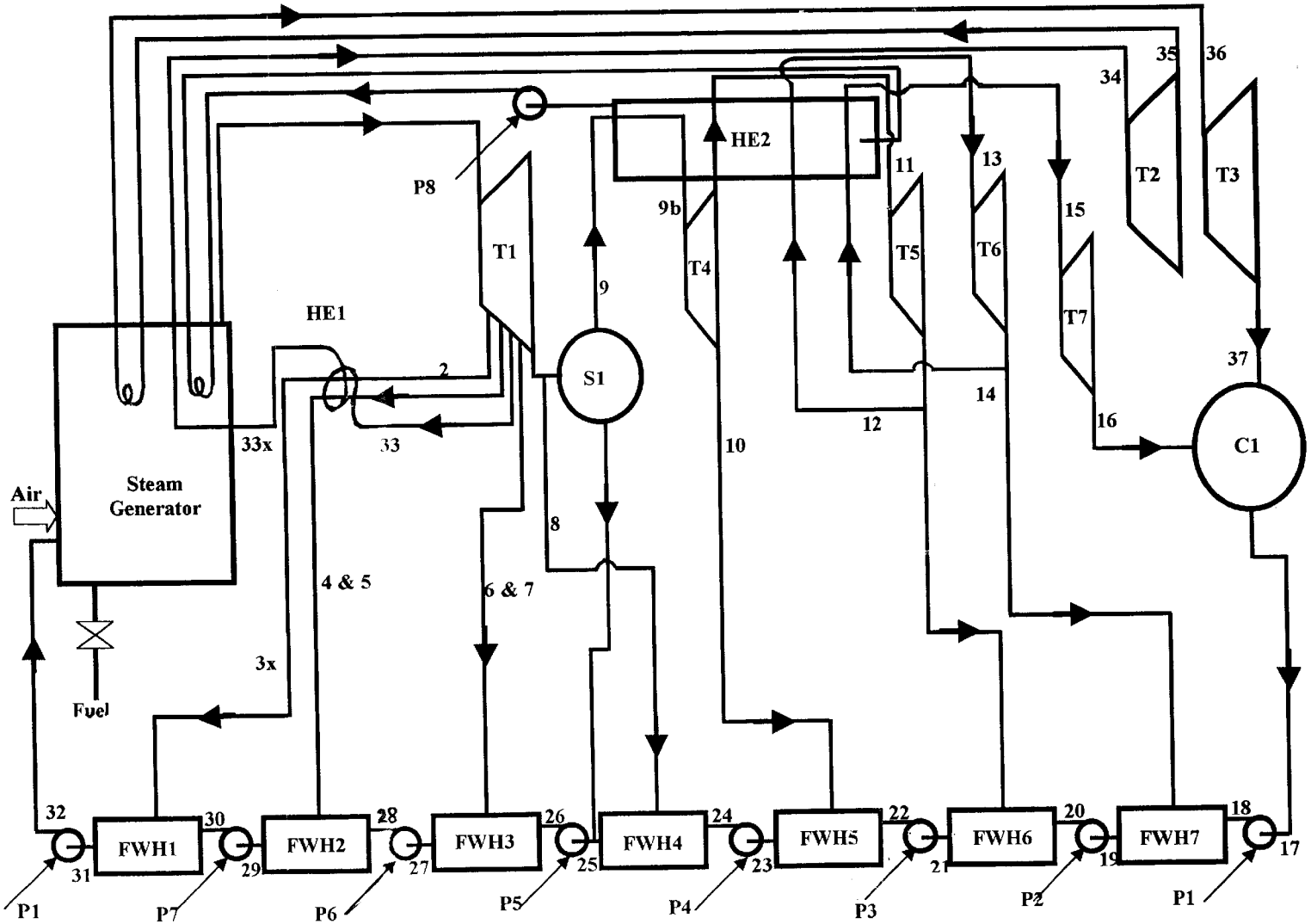
FIG. 15 is a schematic diagram similar to FIG. 13 showing an eightieth arrangement of a steam power cycle in a system employing a plurality of turbines, feed heaters, pumps, and separators and embodying the invention.
Figure 16:
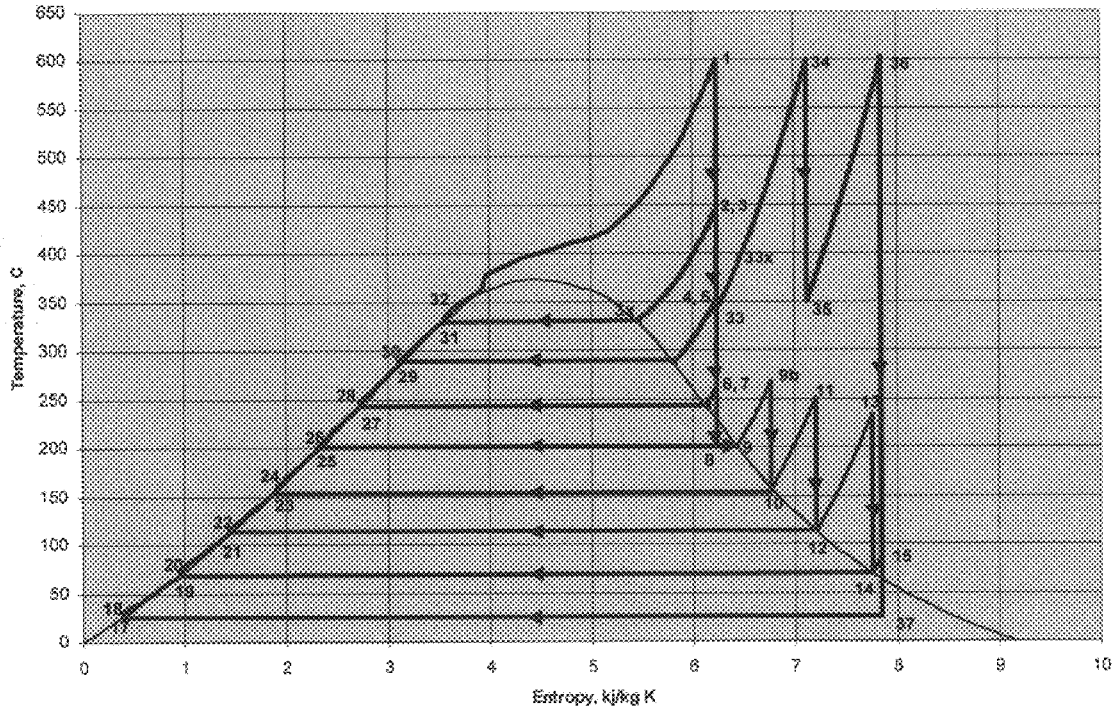
FIG. 16 is an illustrative diagram of the cycle shown in FIG. 15 as it is ideally represented on a temperature-entropy diagram.

FIG. 15 shows the exact same cycle that is shown in FIG. 11 except that there is an additional heat exchanger to reduce the superheat temperature of the superheated steam at 2 that is extracted from large turbine T1 for the purpose of heating the hot water of feed heater FWH1. As the superheated steam at 2 is cooled as it passes through heat exchanger HE1, the steam extracted from large turbine T1 at point 33 is heated as it passes through heat exchanger HE1 to a temperature of about 392° C. at point 33*x*. The conditions at point 2 are a pressure of about 129.7 bar and a temperature of about 455° C. The conditions at point 33 are a temperature of about 357° C. and at a lower pressure than that at point 2. The superheated steam at 2 that enters heat exchanger HE1 exits the heat exchanger at point 3*x* where its temperature is about 367° C. FIG. 16 shows the thermal characteristics of the cycle shown in FIG. 15 as they are represented ideally on the temperature-entropy diagram.

Figure 17:
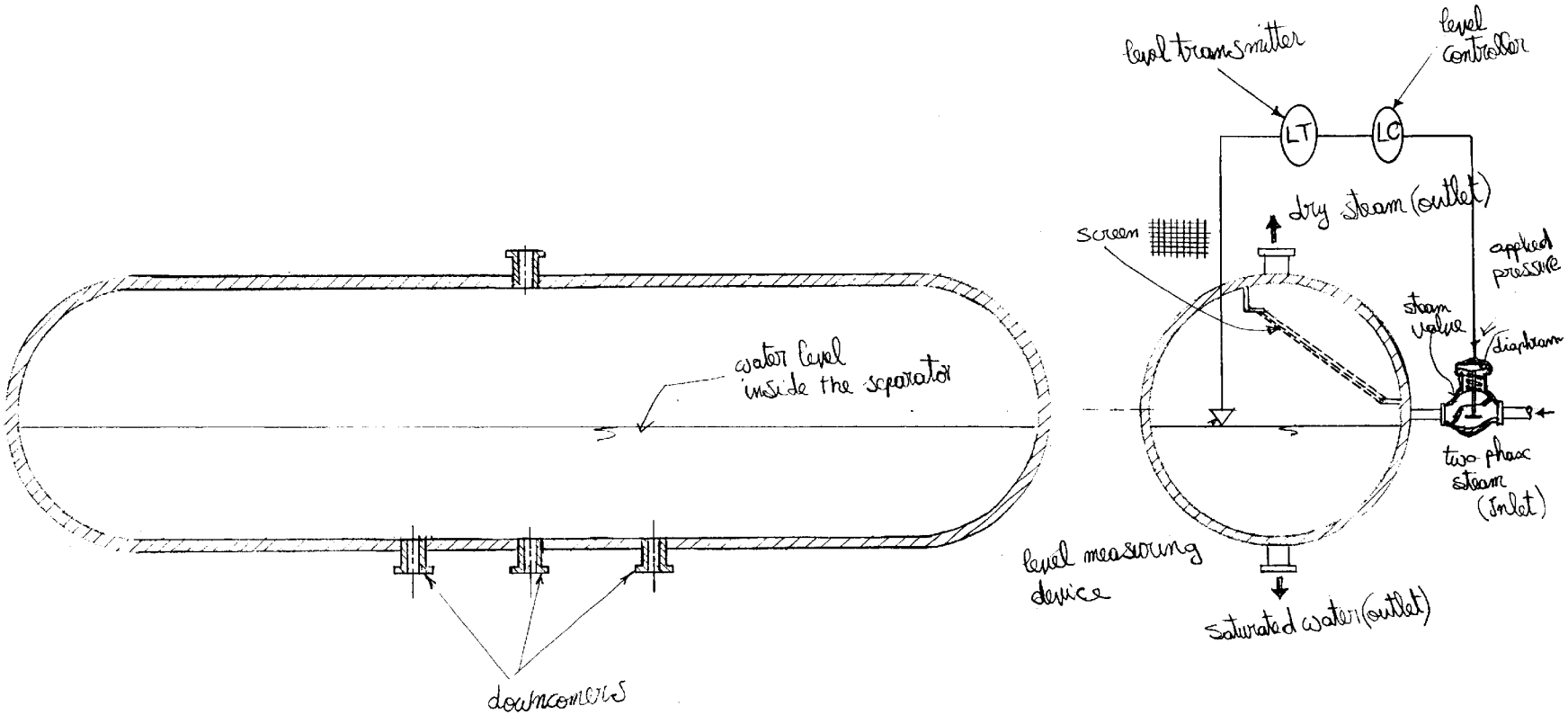
FIG. 17 is diagrammatic illustration of a steam separator.

Steam separators are used in all modern steam generators except once-through types. The steam separator is shown in FIG. 17. The steam separator comprises a closed cylinder that has one inlet and two outlets. The steam separator separates the wet (two-phase steam) to dry saturated steam and saturated water. Wet steam enters the drum from its side. Saturated water has higher density than steam comes out of the downcomers. Saturated steam entrains water and exits the top of the drum. The shown screens increase the efficiency of separation by allowing only dry steam to go through. The water level inside the drum has to be controlled to be within a specific range for efficient operation. The level control can be done measuring the water level inside the drum instantaneously using a level measuring device that has instantaneous output signal connected to a level transmitter. The output of the transmitter is connected to a controller that is connected to a control valve that controls the inlet wet steam to the drum as shown in FIG. 17. If the set value for the water level was lower than the measured value, the controller will send a signal to the control valve to open the valve (by exerting a greater pressure or a smaller pressure on the valve diaphragm depending on the kind of valve). If the set value for the valve level was higher than the measured value, the controller signal will be to close the valve to reduce the water level inside the drum.

Figure 18:
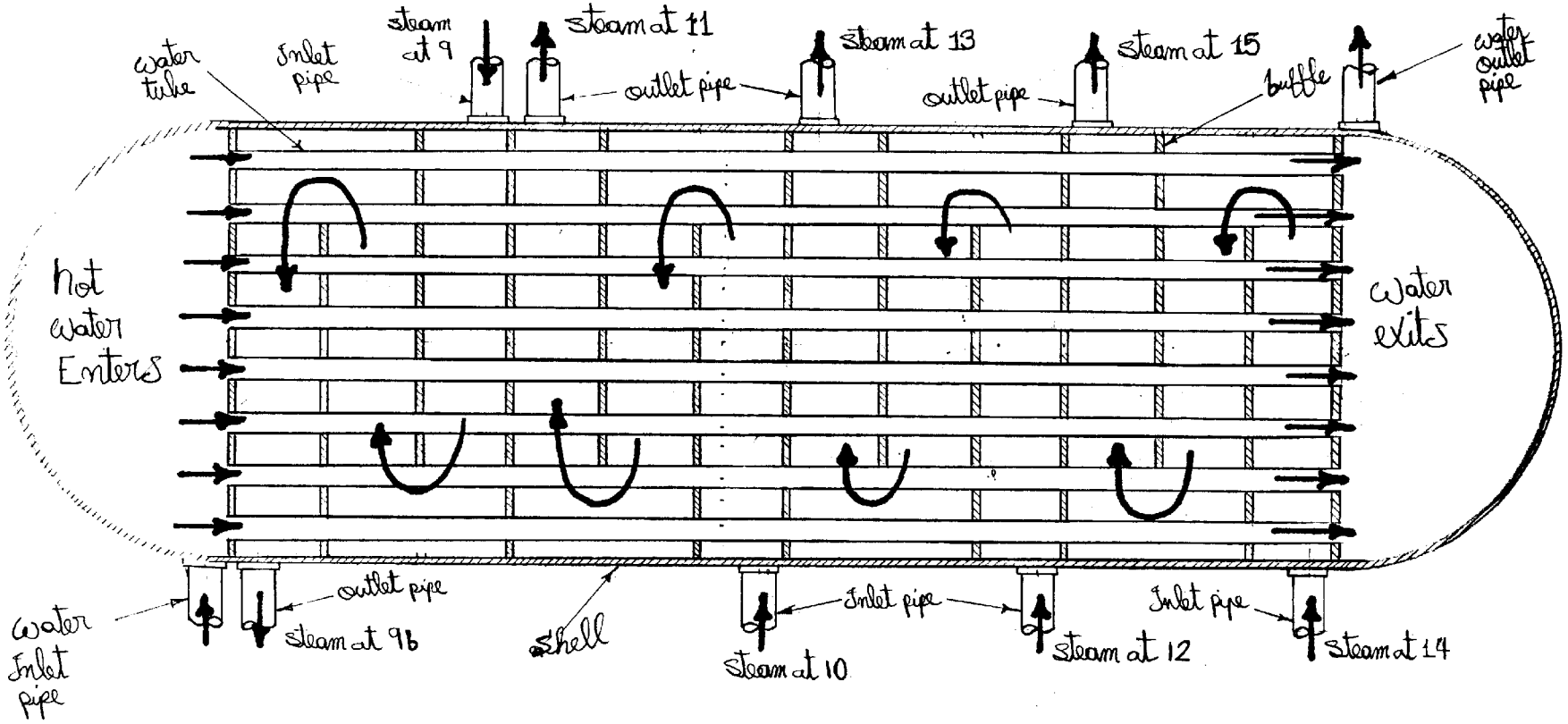
FIG. 18 is a diagrammatic illustration of a multi-pass heat exchanger.

FIG. 18 shows the multi-pass shell and tube heat exchanger. The heat exchanger comprises a shell that has many tubes through which high-pressure, hot water passes through. The spaces around the tubes have buffles that support the tubes and direct the steam flow around the tubes to be in counter directions to the water flow inside the tubes to achieve the highest temperature difference and heat transfer rate. The shell is divided to four sections for four passages. The first passage is for steam outlet of separator S1 at 9 that enters that passage of the multi-pass heat exchanger where steam is superheated to enter turbine T4 at point 9*b*. The second passage for steam outlet of turbine T4 at point 10 that enters that passage of the multi-pass heat exchanger where steam is superheated and exit the shell to enter turbine T5 at point 11. The third passage for steam outlet of turbine T5 at point 12 that enters that passage of the multi-pass heat exchanger where steam is superheated and exit the shell to enter turbine T6 at point 13. The fourth passage is for steam outlet of turbine T6 at point 14 that enters that passage of the multi-pass heat exchanger where steam is superheated and exit the shell to enter turbine T7 at point 15.

From the foregoing description it will be evident that the invention is applicable to a wide variety of arrangements of power systems and it is to be understood as embracing all such systems as may fall within the terms of the appended claims when construed as broadly as is consistent with the state of prior art.

What I claim is:

1. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a first steam separator if said last portion was in the two-phase region, expanding dry steam output of steam separators in small turbines, allowing portions of the output of small turbines to be dried in steam separators except the output of the lowest pressure small turbine where its output heats the feed water heater that has the lowest pressure, allowing saturated water output of said steam separators to be mixed with water output of feed water heaters that have the pressures that are very close to the pressures in said steam separators, reheating said the remainder portion of said generated steam in one or more steps in said steam generator, allowing said the remainder portion of said generated steam to drive large turbines after reheating, condensing the output steam from the lowest pressure large turbine in a condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing an expansion step in one of said small turbines and a drying step in one of said steam separators for each of said feed water heaters except the feed water heater if the expanded steam was in two-phase region that has the lowest pressure that is not connected with a steam separator.

2. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a first steam separator if said last portion was in the two-phase region, expanding dry steam output of steam separators in small turbines, allowing portions of the output of small turbines to be dried in steam separators except the output of the lowest pressure small turbine where its output heats the feed water heater that has the lowest pressure, allowing saturated water output of said steam separators to be mixed with water output of feed water heaters that have the pressures that are very close to the pressures in said steam separators, heating said the remainder portion of said generated steam using said portion of steam extracted from said first large turbine in an additional heat exchanger if the temperature of said portion of steam extracted was higher than the temperature of said the remainder portion of said generated steam, reheating said the remainder portion of said generated steam in one or more steps in said steam generator, allowing said the remainder portion of said generated steam to drive large turbines after reheating, condensing the output steam from the lowest pressure large turbine in a condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing an expansion step in one of said small turbines and a drying step in one of said steam separators for each of said feed water heaters if the expanded steam was in two-phase region except the feed water heater that has the lowest pressure that is not connected with a steam separator.

3. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a first steam separator if said last portion was in the two-phase region, expanding dry steam output of steam separators in small turbines, allowing portions of the output of small turbines to be dried in steam separators except the output of the lowest pressure small turbine where its output condenses in a condenser, allowing saturated water output of said steam separators to be mixed with water output of feed water heaters that have the pressures that are very close to the pressures in said steam separators, reheating said the remainder portion of said generated steam in one or more steps in said steam generator, allowing said the remainder portion of said generated steam to drive large turbines after reheating, condensing the output steam from the lowest pressure large turbine in said condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing an expansion step in one of said small turbines and a drying step in one of said steam separators for each of said feed water heaters if the expanded steam was in two-phase region.

4. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a first steam separator if said last portion was in the two-phase region, expanding dry steam output of steam separators in small turbines, allowing portions of the output of small turbines to be dried in steam separators except the output of the lowest pressure small turbine where its output condenses in a condenser, allowing saturated water output of said steam separators to be mixed with water output of feed water heaters that have the pressures that are very close to the pressures in said steam separators, heating said the remainder portion of said generated steam using said portion of steam extracted from said first large turbine in an additional heat exchanger if the temperature of said portion of steam extracted was higher than the temperature of said the remainder portion of said generated steam, reheating said the remainder portion of said generated steam in one or more steps in said steam generator, allowing said the remainder portion of said generated steam to drive large turbines after reheating, condensing the output steam from the lowest pressure large turbine in said condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing an expansion step in one of said small turbines and a drying step in one of said steam separators for each of said feed water heaters if the expanded steam was in two-phase region.

5. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a steam separator if said last portion was in the two-phase region, allowing the dry steam output of said steam separator before expanding in a first small turbine to be reheated in a multi-pass heat exchanger where steam at different pressures counter passes a heating medium of a high pressure water or any other heating medium in many sections of that heat exchanger, expanding the reheated steam output of said multi-pass heat exchanger in small turbines, allowing portions of the output of small turbines to be reheated in said multi-pass heat exchanger except the output of the lowest pressure small turbine where its output heats the feed water heater that has the lowest pressure, allowing saturated water output of said steam separator to be mixed with water output of the feed water heater that has the pressure that is very close to the pressure in said steam separator, reheating said the remainder portion of said generated steam in one or more steps in said steam generator, allowing said the remainder portion of said generated steam to drive large turbines after reheating, condensing the output steam from the lowest pressure large turbine in a condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing only one drying step for the entire cycle in said steam separator to dry said two-phase steam.

6. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a steam separator if said last portion was in the two-phase region, allowing the dry steam output of said steam separator before expanding in a first small turbine to be reheated in a multi-pass heat exchanger where steam at different pressures counter passes a heating medium of a high pressure water or any other heating medium in many sections of that heat exchanger, expanding the reheated steam output of said multi-pass heat exchanger in small turbines, allowing portions of the output of small turbines to be reheated in said multi-pass heat exchanger except the output of the lowest pressure small turbine where its output heats the feed water heater that has the lowest pressure, allowing saturated water output of said steam separator to be mixed with water output of the feed water heater that has the pressure that is very close to the pressure in said steam separator, heating said the remainder portion of said generated steam using said portion of steam extracted from said first large turbine in an additional heat exchanger if the temperature of said portion of steam extracted was higher than the temperature of said the remainder portion of said generated steam, reheating said the remainder portion of said generated steam in one or more steps in said steam generator, allowing said the remainder portion of said generated steam to drive large turbines after reheating, condensing the output steam from the lowest pressure large turbine in a condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing only one drying step for the entire cycle in said steam separator to dry said two-phase steam.

7. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a steam separator if said last portion was in the two-phase region, allowing the dry steam output of said steam separator before expanding in a first small turbine to be reheated in a multi-pass heat exchanger where steam at different pressures counter passes a heating medium of a high pressure water or any other heating medium in many sections of that heat exchanger, expanding the reheated steam output of said multi-pass heat exchanger in small turbines, allowing portions of the output of small turbines to be reheated in said multi-pass heat exchanger except the output of the lowest pressure small turbine where its output condenses in a condenser, allowing saturated water output of said steam separator to be mixed with water output of the feed water heater that has the pressure that is very close to the pressure in said steam separator, heating said the remainder portion of said generated steam using said portion of steam extracted from said first large turbine in an additional heat exchanger if the temperature of said portion of steam extracted was higher than the temperature of said the remainder portion of said generated steam, reheating said the remainder portion of said generated steam in one or more steps in said steam generator, allowing said the remainder portion of said generated steam to drive large turbines after reheating, condensing the output steam from the lowest pressure large turbine in said condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing only one drying step for the entire cycle in said steam separator to dry said two-phase steam.

8. An improved method of operation of a continuous combustion type power system comprising the steps:

generating steam in a steam generator, driving a first large turbine by the generated steam from said steam generator, extracting portions of steam from said first large turbine for the purpose of heating feed water during a regeneration process that portions of steam are not reheated with the remainder portion of said generated steam that expand to lower pressures, allowing the last portion of said portions of steam extracted from said first large turbine to be dried in a steam separator if said last portion was in the two-phase region, allowing the dry steam output of said steam separator before expanding in a first small turbine to be reheated in a multi-pass heat exchanger where steam at different pressures counter passes a heating medium of a high pressure water or any other heating medium in many sections of that heat exchanger, expanding the reheated steam output of said multi-pass heat exchanger in small turbines, allowing portions of the output of small turbines to be reheated in said multi-pass heat exchanger except the output of the lowest pressure small turbine where its output condenses in a condenser, allowing saturated water output of said steam separator to be mixed with water output of the feed water heater that has the pressure that is very close to the pressure in said steam separator, reheating said the remainder portion of said generated steam in one or more steps in said steam generator, allowing said the remainder portion of said generated steam to drive large turbines after reheating, condensing the output steam from the lowest pressure large turbine in said condenser that is cooled by any suitable working fluid, using a first pump for pumping the condensing water with increase in pressure, using a first feed water heater for heating the pumped water with outlet steam of the lowest pressure small turbine by direct or indirect contact with said pumped water, using other pumps for pumping the pumped water output of one feed water heater to the following feed water heater in a train of feed water heaters, using steam extracted from said first large turbine or using portions of the output of said small turbines to heat said pumped water in feed water heaters by direct or indirect contact with the pumped water so that as the steam is used for regeneration is expanding in a two-phase region to lower pressures, providing only one drying step for the entire cycle in said steam separator to dry said two-phase steam.

* * * * *